US008714124B2

(12) United States Patent
Koiwa

(10) Patent No.: US 8,714,124 B2
(45) Date of Patent: May 6, 2014

(54) COVER STRUCTURE FOR INTERNAL COMBUSTION ENGINE

(71) Applicant: Honda Motor Co., Ltd., Tokyo (JP)

(72) Inventor: Yojiro Koiwa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/683,553

(22) Filed: Nov. 21, 2012

(65) Prior Publication Data

US 2013/0133611 A1 May 30, 2013

(30) Foreign Application Priority Data

Nov. 25, 2011 (JP) ..... 2011-258261
Nov. 25, 2011 (JP) ..... 2011-258262

(51) Int. Cl.
*F01M 9/10* (2006.01)

(52) U.S. Cl.
USPC ..... 123/90.38; 123/195 C

(58) Field of Classification Search
CPC ..... F02F 7/00; F02F 7/006; F02F 7/0068; F02F 7/007; F02F 7/0082
USPC ..... 123/195 C, 195 R, 198 DA, 198 E, 90.38
See application file for complete search history.

(56) References Cited

U.S. PATENT DOCUMENTS 5,148,784 A * 9/1992 Hiraoka et al. ..... 123/195 C
6,182,624 B1 * 2/2001 Ozeki ..... 123/90.33
6,619,253 B2 * 9/2003 Kobayashi et al. ..... 123/195 C
6,923,154 B2 * 8/2005 Gschwindt et al. ..... 123/195 C
7,836,859 B2 * 11/2010 Iwata et al. ..... 123/90.38

FOREIGN PATENT DOCUMENTS

| | | | |
|---|---|---|---|
| JP | 08-074597 | A | 3/1996 |
| JP | 2009-197780 | A | 3/1996 |
| JP | 2002-130051 | A | 5/2002 |
| JP | 2004-353551 | A | 12/2004 |
| JP | 2005-042587 | A | 2/2005 |
| JP | 2007-064100 | A | 3/2007 |
| JP | 2008-175153 | A | 7/2008 |
| JP | 2010-285943 | A | 12/2010 |

OTHER PUBLICATIONS

Japanese Office Action Appln. No. 2011-258261 dated Oct. 15, 2013.
Japanese Office Action Appln. No. 2011-258262 dated Oct. 15, 2013.

* cited by examiner

*Primary Examiner* — Lindsay Low
*Assistant Examiner* — Hung Q Nguyen
(74) *Attorney, Agent, or Firm* — Arent Fox LLP

(57) ABSTRACT

A cover structure, for an internal combustion engine, that can inhibit lubricating oil from remaining at a protrusion portion is provided. The cover structure for an engine includes a chain case that covers a timing train mechanism, and a timing train chamber is formed between the chain case and the engine main body. The chain case includes bolt insertion holes provided at side marginal portions and directed toward the engine main body, a variable-valve boss portion and a second-oil-path boss portion that protrude from a wall portion toward the engine main body and form a recessed portion where lubricating oil for lubricating the timing train mechanism remains, and a first rib that is protruding from the wall portion toward the engine main body and provided upper than at least the recessed portion.

9 Claims, 14 Drawing Sheets

COVER STRUCTURE FOR INTERNAL COMBUSTION ENGINE

CROSS REFERENCE TO RELATED APPLICATION

The present application claims benefit of the filing date of Japanese Patent Applications No. 2011-258261 filed on Nov. 25, 2011, and No. 2011-258262 filed on Nov. 25, 2011, the disclosure of which is incorporated herein by reference.

BACKGROUND OF THE INVENTION

1. Field of the Invention

The present invention relates to a cover structure for an internal combustion engine.

2. Description of the Related Art

In general, a protrusion portion protruding toward an engine main body is provided on the inner surface (rear surface) of a chain case that covers a timing chain for transferring the rotation of a crank shaft of an engine to cam shafts.

For example, Patent Document 1 (JP 2002-130051 A) discloses an invention wherein there is provided a plurality of central fastening portions that are formed, such as to protrude from the inner surface of a chain case, struck against an engine main body, and fastened by bolts, and there are also provided connection portions that are formed such as to protrude from the inner surface of the chain case, make connections between the central fastening portions, and are struck against the engine main body.

SUMMARY OF THE INVENTION

In case of providing protrusion portions, such as the above-described central fastening portions, the connection portions, and the like, lubricating oil having flowed along the inner surface of the chain case may remain on the upper surfaces of the protrusion portions and the like. In this situation, it is has been desired that lubricating oil is inhibited from such remaining.

The present invention has been developed from this point of view. An object of the invention is to provide a cover structure, for an internal combustion engine, capable of inhibiting lubricating oil from remaining at a protrusion portion.

In order to solve the above-described problem, the present invention provides a cover structure for an internal combustion engine, the cover structure including: a timing train mechanism provided on one sidewall of a main body of the internal combustion engine; and a cover member for covering the timing train mechanism, a timing train chamber is formed between the cover member and the main body of the internal combustion engine, wherein the cover member includes: side fastening portions that are provided at a pair of side marginal portions separated from each other and fastened to the main body of the internal combustion engine; a protrusion portion that protrudes from an inner surface of a wall portion connecting the pair of side marginal portions toward the main body of the internal combustion engine and has a lubricating oil remaining part where lubricating oil for lubricating the timing train mechanism remains; and a first rib that protrudes from the inner surface of the wall portion toward the main body of the internal combustion engine and is provided upper in a cylinder axial direction than at least the lubricating oil remaining part.

According to the invention, as the first rib is provided upper in the cylinder axial direction than the lubricating oil remaining part of the protrusion portion, lubricating oil having flowed along the inner surface of the wall portion of the cover member is guided to the first rib to thereby flow along the first rib. Thus, it is possible to inhibit lubricating oil from remaining at the lubricating oil remaining part of the protrusion portion.

Further, it is preferable that the protrusion portion includes a plurality of main body portions provided with respective certain distances therebetween and connection portions connecting the main body portions, wherein the lubricating oil remaining part is formed upper than the main body portions and the connection portions, and wherein the first rib is provided such as to enclose the main body portions and the connection portions.

With such a structure, as the first rib is provided such as to enclose the main body portions and the connection portions of the protrusion portion, it is possible to further inhibit lubricating oil from remaining at the protrusion portion.

Still further, it is preferable that a part of the first rib, the part being arranged upper in the cylinder axial direction than the lubricating oil remaining part, is substantially linearly formed such as to be downward inclined toward either one of the pair of side marginal portions.

With such a structure, as the part of the first rib, the part being arranged upper in the cylinder axial direction than the lubricating oil remaining part, is substantially linearly formed such as to be downward inclined toward either one of the pair of side marginal portions, lubricating oil having flowed along the inner surface of the wall portion of the cover member smoothly and surely flows along the first rib due to the own weight thereof. Thus, it is possible to inhibit lubricating oil from remaining at the first rib.

Yet further, it is preferable that a protrusion end surface of the protrusion portion is in contact with the one sidewall of the main body of the internal combustion engine, wherein the cover member further includes a seal member provided between the protrusion portion and the main body of the internal combustion engine; and the seal member is provided in a vicinity of the first rib.

In such a structure, as the seal member provided between the protrusion portion and the main body of the internal combustion engine is provided in a vicinity of the first rib, the rigidity of the vicinity of the seal member is improved, and the tight contact of the seal member with the main body of the internal combustion engine is improved. Accordingly, satisfactory sealing is ensured.

Further, it is preferable that the cover member further includes a plurality of central fastening portions that are provided at the wall portion and fastened to the main body of the internal combustion engine, wherein the central fastening portions are provided with respective certain distances therebetween around the protrusion portion; and the central fastening portions are connected by the first rib and at least a part of the seal member.

In such a structure, as the plurality of central fastening portions provided with respective certain distances therebetween are connected by the first rib and at least a part of the seal member, the first rib and at least a part of the seal member are disposed adjacent to each other between the central fastening portions. Accordingly, a further satisfactory sealing is ensured.

Still further, it is preferable that the cover member further includes a second rib that protrudes from the inner surface of the wall portion toward the main body of the internal combustion engine and extends along the cylinder axial direction, wherein and the first rib is formed substantially in an upside-down triangle shape and a lower end portion thereof is connected to the second rib.

With such a structure, as the first rib is formed substantially in an upside-down triangle shape, lubricating oil having flowed along the inner surface of the wall portion of the cover member flows along the first rib to be collected at the lower end portion of the first rib. Then, as the lower end portion of the first rib is connected with the second rib extending along the cylinder axial direction, the lubricating oil collected at the lower end portion of the first rib is guided to the second rib. Thus, lubricating oil can be quickly recovered.

Yet further, it is preferable that the timing train mechanism includes: a driving wheel; a driven wheel; and an endless timing chain suspended between the driving wheel and the driven wheel, wherein the cover member further includes a third rib that protrudes from the inner surface of the wall portion toward the main body of the internal combustion engine, the third rib being provided between both or either one of the pair of side marginal portions and the second rib, and is inclined such that the closer to the second rib, the lower in the cylinder axial direction, wherein the second rib is provided on an inner side of the timing chain and formed higher than the third rib, and a lower end portion, in the cylinder axial direction, of the second rib is located upper in the cylinder axial direction than the driving wheel, and wherein the third rib is formed such that an end portion on the side marginal portion side is higher than a portion midway along a longitudinal direction.

With such a structure, as the third rib is provided between the second rib extending along the cylinder axial direction and both or either one of the pair of side marginal portions, lubricating oil having flowed along the side marginal portion/portions of the cover member is ensured to be guided to the third rib. Further, the third rib is inclined such that the closer to the second rib, the lower in the cylinder axial direction, and the second rib is formed higher than the third rib. Accordingly, the lubricating oil having been guided to the third rib is ensured to be guided to the second rib along the third rib by the own weight thereof. Further, as the lower end portion, in the cylinder axial direction, of the second rib is located upper in the cylinder axial direction than the driving wheel, the lubricating oil having been guided to the second rib is ensured to be guided along the second rib to the driving wheel by the own weight thereof.

In such a manner, lubricating oil having flowed along the side marginal portion/portions of the cover member can be surely flowed to the driving wheel.

Further, as the second rib is provided inside the timing chain, interference between the second rib and the timing chain can be prevented. As interference between these two can be prevented, the height of the second rib can be freely set.

Further, as the third rib is formed such that the end portion on the side marginal portion side is higher than a portion midway along a longitudinal direction, interference between the third rib and the timing chain can be prevented by arranging the timing chain such as to pass the portion midway, along the longitudinal direction, of the third rib.

Further, it is preferable that the timing train mechanism further includes: a slide-contact member that slidably contacts with the timing chain to apply a certain tension; and an urging member having a contact portion that contacts with the slide-contact member to urge the slide-contact member toward the timing chain, wherein a drain oil path communicating with a drain portion of a hydraulic control valve is provided in a vicinity of either one of the pair of side marginal portions, wherein the contact portion is provided lower in the cylinder axial direction than the drain oil path, and wherein the third rib is provided upper in the cylinder axial direction than the drain oil path.

With such a structure, the contact portion of the urging member that contacts with the slide-contact member is provided lower in the cylinder axial direction than the drain oil path communicating with the drain portion of the control valve and the third rib is provided upper in the cylinder axial direction than the drain oil path. Accordingly, lubricating oil having flowed from the drain oil path into the cover member tends not to be guided to the third rib but to be guided to the contact portion. Thus, lubrication is carried out between the slide-contact member and the contact portion, and further, it is possible to perform lubrication, distributing oil to the driving wheel and the contact portion.

Still further, it is preferable that the cover member further includes a fourth rib that protrudes from the one side marginal portion toward the contact portion side and is provided lower in the cylinder axial direction than the drain oil path.

With such a structure, by arranging the fourth rib that protrudes from the side marginal portion toward the contact portion side and is provided lower in the cylinder axial direction than the drain oil path, lubricating oil having flowed from the drain oil path into the cover member tends to be further easily guided along the fourth rib by the contact portion. Thus, lubrication between the slide-contact member and the contact portion is carried out further easily.

According to the invention, it is possible to provide a cover structure, for an internal combustion engine, capable of inhibiting lubricating oil from remaining at a protrusion portion.

BRIEF DESCRIPTION OF THE DRAWINGS

FIGS. 1A and 1B are schematic structural diagrams of an engine having a cover structure for an internal combustion engine, wherein FIG. 1A is a side view and FIG. 1B is a front view;

DETAILED DESCRIPTION OF THE PREFERRED EMBODIMENTS

Figure 1B:
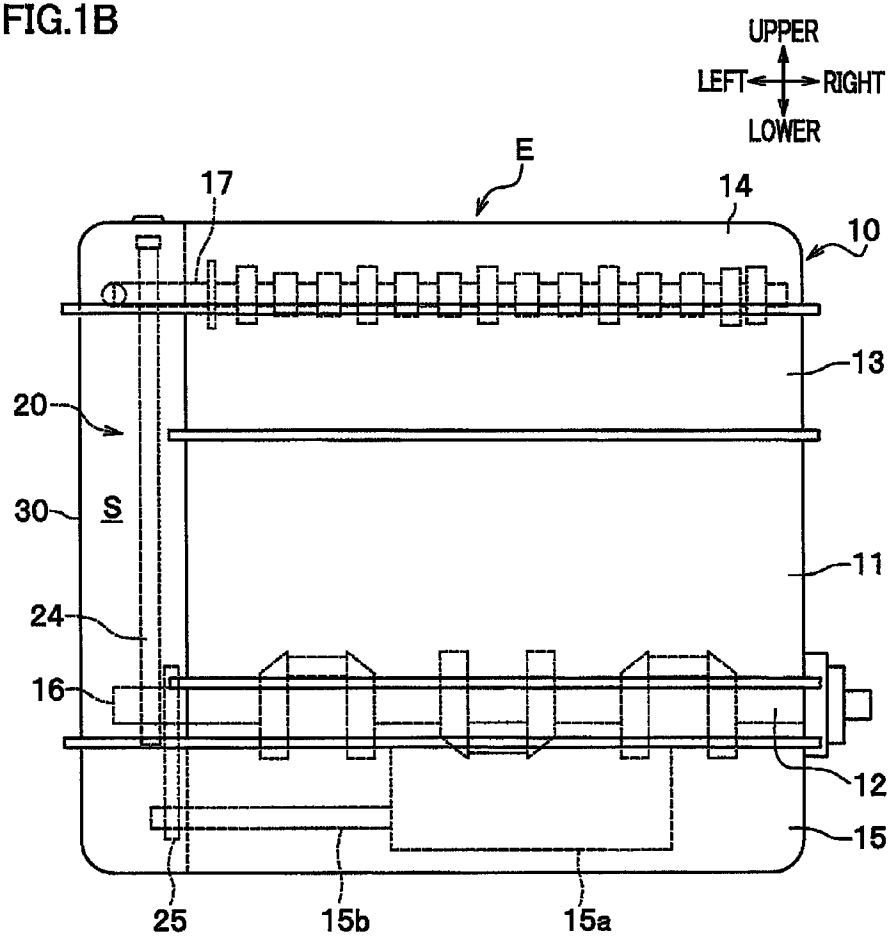

A preferred embodiment according to the present invention will be described below in detail, referring to the drawings. In the description, the same symbol will be assigned to the same element, and overlapped description will be omitted. In the present embodiment, description will be made, taking an example of a case where the present invention is applied to the engine of an automobile. Directions will be described, based on the front/rear/upper/lower/left/right of a vehicle shown in FIG. 1.

In the present embodiment, it is assumed that the upper/lower direction agrees with the vertical direction, and the cylinder axial direction is inclined from the upper/lower direction (vertical direction) by a certain angle toward the front side. The axial direction is assumed to be a direction parallel to the rotational axis of a crankshaft and cam shafts. Further, the perpendicular direction is assumed to be a direction perpendicular to the cylinder axial direction when viewed from the axial direction. The upper side and the lower side with respect to the cylinder perpendicular plane, which is a plane perpendicular to the cylinder axial direction, will be respectively referred to as upper and lower.

Figure 1A:
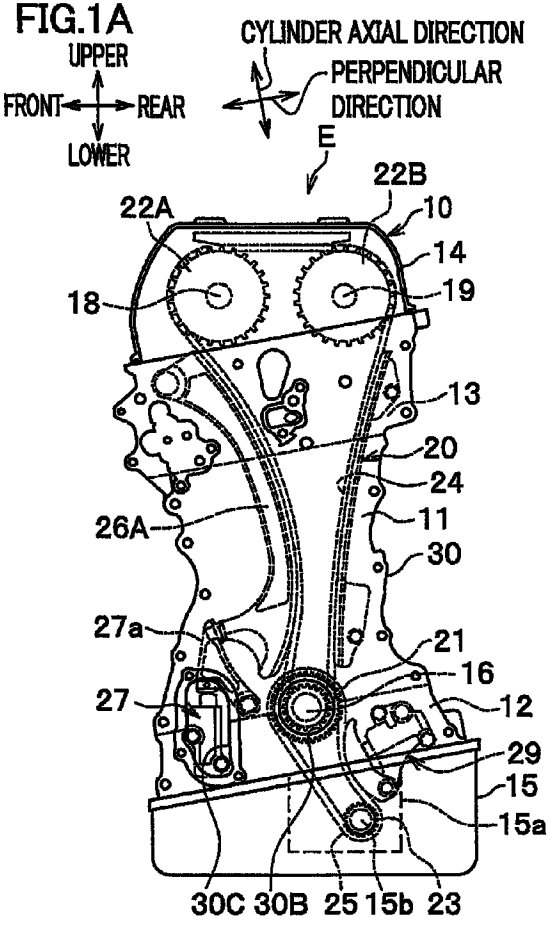
Figure 2:
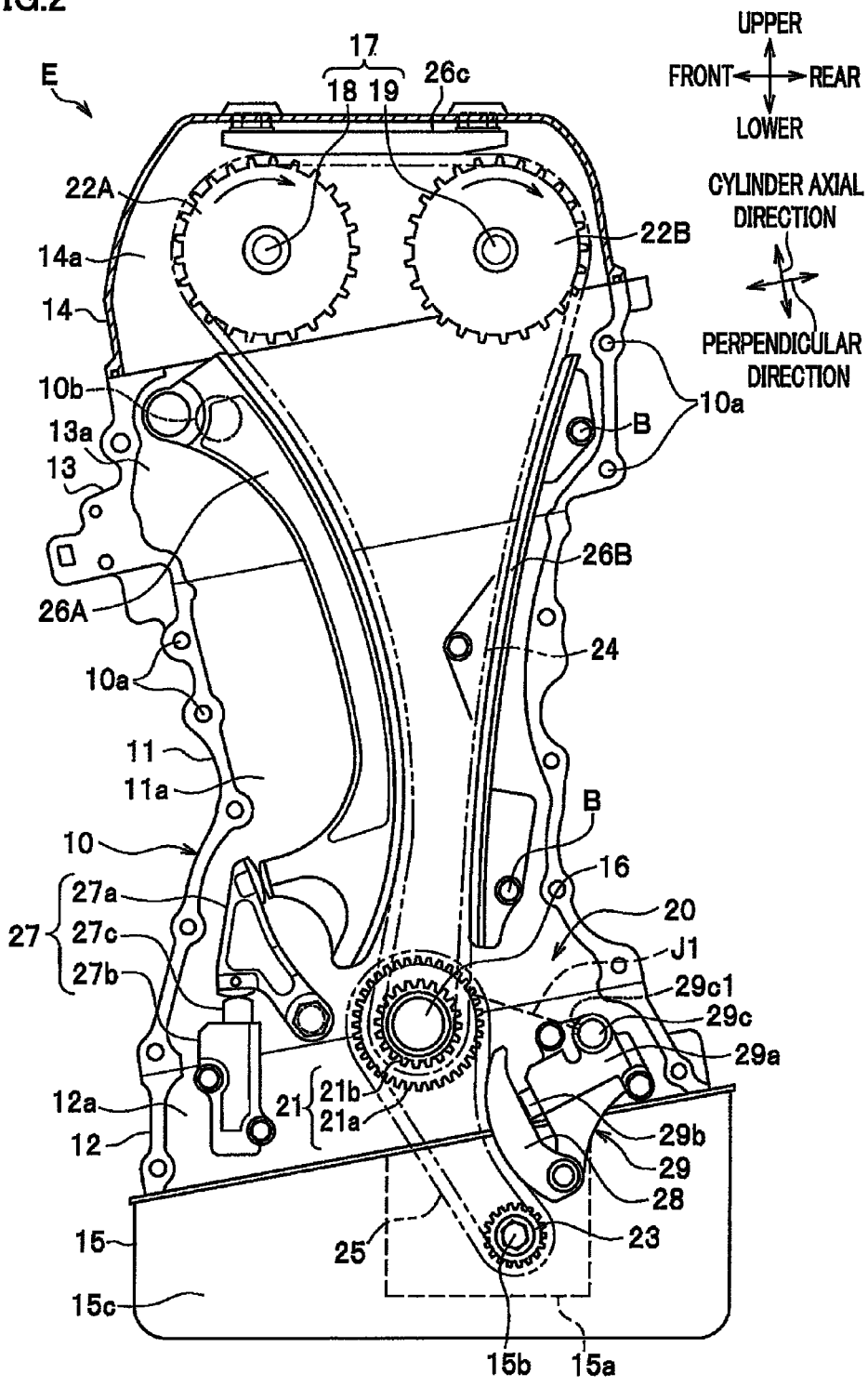
FIG. 2 is a side view showing a state that the chain case is detached from the engine.

FIGS. 1A and 1B are schematic structural diagrams of an engine E having a cover structure for an internal combustion engine, wherein FIG. 1A is a side view and FIG. 1B is a front view. FIG. 2 is a side view showing a state that a chain case 30 is detached from the engine E.

As shown in FIG. 1A and FIG. 1B, the engine E is, for example, a DOHC tandem engine that is transverse-mounted on a vehicle body. The engine E mainly includes an engine main body 10, a timing train mechanism 20, and a chain case 30.

Engine Main Body

The engine main body 10 includes, as shown in FIG. 2, a cylinder block 11, a lower block 12, a cylinder head 13, a head cover 14, and an oil pan 15.

Cylinder Block

Though not shown, the cylinder block 11 is a member that mainly forms cylinder bores and a crankcase. Pistons, connecting rods, a crankshaft 16, and the like are housed inside the cylinder block 11.

Lower Block

A lower block 12 is a member that forms, with the cylinder block 11, the crankcase and is disposed under the cylinder block 11. The end portions of the crankshaft 16 are rotatably sandwiched by the sidewalls 11*a* of the cylinder block 11 and the sidewalls 12*a* of the lower block 12.

Cylinder Head

The cylinder head 13 is a member that forms, with the cylinder block 11, combustion chambers and is disposed on the cylinder block 11. Though not shown, inside the cylinder head 13, intake ports and exhaust ports communicating with respective combustion chambers are formed, and intake valves, exhaust valves, rocker arms, and the like for opening and closing the intake ports and the exhaust ports are disposed. Further, two camshafts 17 are arranged above the cylinder head 13. The camshafts 17 are an intake-side camshaft 18 and an exhaust-side camshaft 19. The intake-side camshaft 18 and the exhaust-side camshaft 19 are disposed parallel such that the axial directions thereof are parallel to each other.

At the both lateral end portions of the sidewalls 11*a* of the cylinder block 11, the sidewalls 12*a* of the lower block 12, the sidewalls 13*a* of the cylinder head 13, there are formed plural bolt insertion holes 10*a*, 10*a* at intervals along the extension directions of the above-described respective lateral end portions. Further, an oil drop portion 10*b* for supplying oil into the chain case 30 is open through the sidewall 13*a*.

Head Cover

The head cover 14 is a member in a lid shape that forms a valve train chamber by closing the upper portion of the cylinder head 13, and is disposed on the cylinder head 13. The end portions of the intake-side camshaft 18 and the exhaust-side camshaft 19 are rotatably fixed to the sidewalls 14*a* of the head cover 14.

Oil Pan

The oil pan 15 is a member for receiving oil that has lubricated the respective portions in the engine E and drops down to the oil pan 15, wherein the oil pan 15 is disposed under the lower block 12. An oil pump 15*a* for transferring oil by pressure to the respective parts in the engine E is disposed inside the 15 oil pan. One end side of the pump driving shaft 15*b* of the oil pump 15*a* protrudes from the sidewall 15*c* of the oil pan 15.

The crankshaft 16 functions as a driving shaft, while the intake-side camshaft 18, the exhaust-side camshaft 19, and the pump driving shaft 15*b* respectively function as driven shafts.

Timing Train Mechanism

The timing train mechanism 20 is a mechanism that transmits the rotational force of the crankshaft 16 to the pump driving shaft 15*b* and the camshafts 17.

The timing train mechanism 20 mainly includes a crank sprocket 21, cam sprockets 22A, 22B, an oil pump sprocket 23, a cam timing chain 24, an oil pump timing chain 25, a movable shoe 26A, a first fixed shoe 26B, a second fixed shoe 26C, a first hydraulic tensioner device 27, a shoe 28, and a second hydraulic tensioner device 29.

Crank Sprocket

The crank sprocket 21, which is a driving wheel, is a gear member that is fixed at one end side of the crankshaft 16, the one end side protruding from a side surface of the engine main body 10, and is arranged to be able to rotate integrally with the crankshaft 16. The crank sprocket 21 includes a first gear portion 21*a* with a larger diameter and a second gear portion 21*b* with a smaller diameter. The first gear portion 21*a* is arranged on the engine main body 10 side with respect to the second gear portion 21*b*. In the present embodiment, the crank sprocket 21 (crankshaft 16) rotates clockwise in FIG. 2.

Cam Sprocket

The cam sprockets 22A, 22B, which are driven wheels, are gear members that are respectively fixed on one end side of the two camshafts 17 protruding from the side surface of the engine main body 10 and are arranged to be able to rotate integrally with the camshafts 17. The cam sprocket 22A is connected to the intake-side camshaft 18 while the cam sprocket 22B is connected to the exhaust-side camshaft 19. By the rotation of the intake-side camshaft 18 and the rotation of the exhaust-side camshaft 19 accompanying the rotation of the cam sprockets 22A, 22B, the intake valves and the exhaust valves open and close at certain timings.

Cam Timing Chain

The cam timing chain 24, which is a timing chain, is an endless chain that transmits the rotational force of the crankshaft 16 to the camshafts 17 and is suspended between the second gear portion 21*b* of the crank sprocket 21 and the cam sprockets 22A, 22B.

Movable Shoe

The movable shoe 26A, which is a slide-contact member, is an arc-shaped elongated member that slidably contacts with the loose side (left side in FIG. 2) of the cam timing chain 24 and guides the cam timing chain 24. The upper end side of the movable shoe 26A is swingably fixed to the sidewall 13*a* of the cylinder head 13. The lower end side of the movable shoe 26A is urged by the first hydraulic tensioner device 27 toward the cam timing chain 24.

First Fixing Shoe

The first fixed shoe 26B is a linear elongated member that slidably contacts with the part (part on the right side in FIG. 1) on the tension side of the cam timing chain 24 and guides the cam timing chain 24. The first fixed shoe 26B is fixed by plural bolts B, B, straddling the sidewall 11*a* of the cylinder block 11 and the sidewall 13*a* of the cylinder head 13.

Second Fixed Shoe

The second fixed shoe 26C is a linear member that is disposed above the cam sprockets 22A, 22B, slidably contacts with the cam timing chain 24, and guides the cam timing chain 24. The second fixed shoe 26C is fixed to the head cover 14.

First Hydraulic Tensioner Device

The first hydraulic tensioner device 27 is a device that adjusts the tension of the cam timing chain 24 to a substantially constant tension by urging the movable shoe 26A toward the cam timing chain 24. The first hydraulic tensioner device 27 includes a contact portion 27*a* in contact with the movable shoe 26A, a housing 27*b* fixed at the sidewall 12*a* of the lower block 12, and a plunger 27*c* protruding from the housing 27*b* to press the contact portion 27*a*.

The contact portion 27*a* is a member substantially in a triangle shape disposed on the lower end side of the movable shoe 26A. The inner lower end portion of the contact portion 27*a* is swingably fixed to the sidewall 11*a* of the cylinder block 11. The outer lower end portion of the contact portion 27*a* is urged by the plunger 27*c* toward the movable shoe 26A.

High pressure oil is supplied to the housing 27*b* from an oil supply path (not shown) of the engine main body 10. Herein, when the contact portion 27*a* is pressed by the plunger 27*c* toward the movable shoe 26A (when the contact portion 27*a* swings clockwise in FIG. 2), the plunger 27*c* having been pushed out from the housing 27*b*, the movable shoe 26A is pressed through the contact portion 27*a* toward the cam timing chain 24, and the tension of the cam timing chain 24 is thereby adjusted to be substantially constant.

Oil Pump Sprocket

The oil pump sprocket 23 is a gear member that is fixed to the pump driving shaft 15*b* protruding from the sidewall 15*c* of the oil pan 15. Herein, the pump driving shaft 15*b* rotates, accompanying rotation of the oil pump sprocket 23, and the oil pump 15*a* thereby drives to supply high pressure oil through the oil supply paths (not shown) to respective portions inside the engine main body 10.

Oil Pump Timing Chain

The oil pump timing chain 25 is an endless chain that transmits the rotational force of the crankshaft 16 to the pump driving shaft 15*b*, and is suspended between the first gear portion 21*a* of the crank sprocket 21 and the oil pump sprocket 23.

Shoe

The shoe 28 is a member in contact with the loose side (right side in FIG. 2) of the oil pump timing chain 25. The lower end portion of the shoe 28 is swingably fixed to the second hydraulic tensioner device 29.

Second Hydraulic Tensioner Device

The second hydraulic tensioner device 29 is a device that urges the shoe 28 toward the oil pump timing chain 25 and thereby adjusts the tension of the oil pump timing chain 25 to be substantially constant. The second hydraulic tensioner device 29 includes a housing 29*a* fixed at the sidewall 12*a* of the lower block 12, a plunger 29*b* that protrudes from the housing 29*a* and presses the shoe 28, and a relief valve 29*c* that is housed in a hollowed portion (not shown) formed in the housing 29*a*.

The housing 29*a* is a member forming the body of the second hydraulic tensioner device 29 and includes therein an oil path, a high pressure oil chamber, and the like. High pressure oil is supplied from an oil supply path (not shown) of the engine main body 10 to the high pressure oil chamber of the housing 29*a*. In this case, the plunger 29*b* pushed out from the housing 29*a* presses the shoe 28 toward the oil pump timing chain 25, and the tension of the oil pump timing chain 25 is thereby adjusted to be substantially constant.

The relief valve 29*c* has functions to exhaust oil from a relief hole 29*c*1 when the oil pressure in the high pressure oil chamber of the housing 29*a* has become higher than or equal to a predetermined value, and to lubricate the timing train mechanism 20, using the exhausted oil. The relief hole 29*c*1 of the relief valve 29*c* is formed, penetrating through the upper rear side of the housing 29*a*. The relief hole 29*c*1 can be provided at an arbitrary position of the housing 29*a*. In the present embodiment, the direction of the axial line J1 of the relief hole 29*c*1 is adjusted such that engagement part between the crank sprocket 21 and the cam timing chain 24 and between the crank sprocket 21 and the oil pump timing chain 25 is disposed on a line extended from the axial line J1 of the relief hole 29*c*1.

Chain Case

Returning to FIG. 1, the chain case 30, which is a cover member, is a member that is fixed to one side surface of the engine main body 10 and covers the cam timing chain 24 from the outer side. That is, a timing train chamber S is formed between the chain case 30 and the engine main body 10 (see FIG. 1B), and the chain case 30 covers the cam timing chain 24.

Figure 3A:
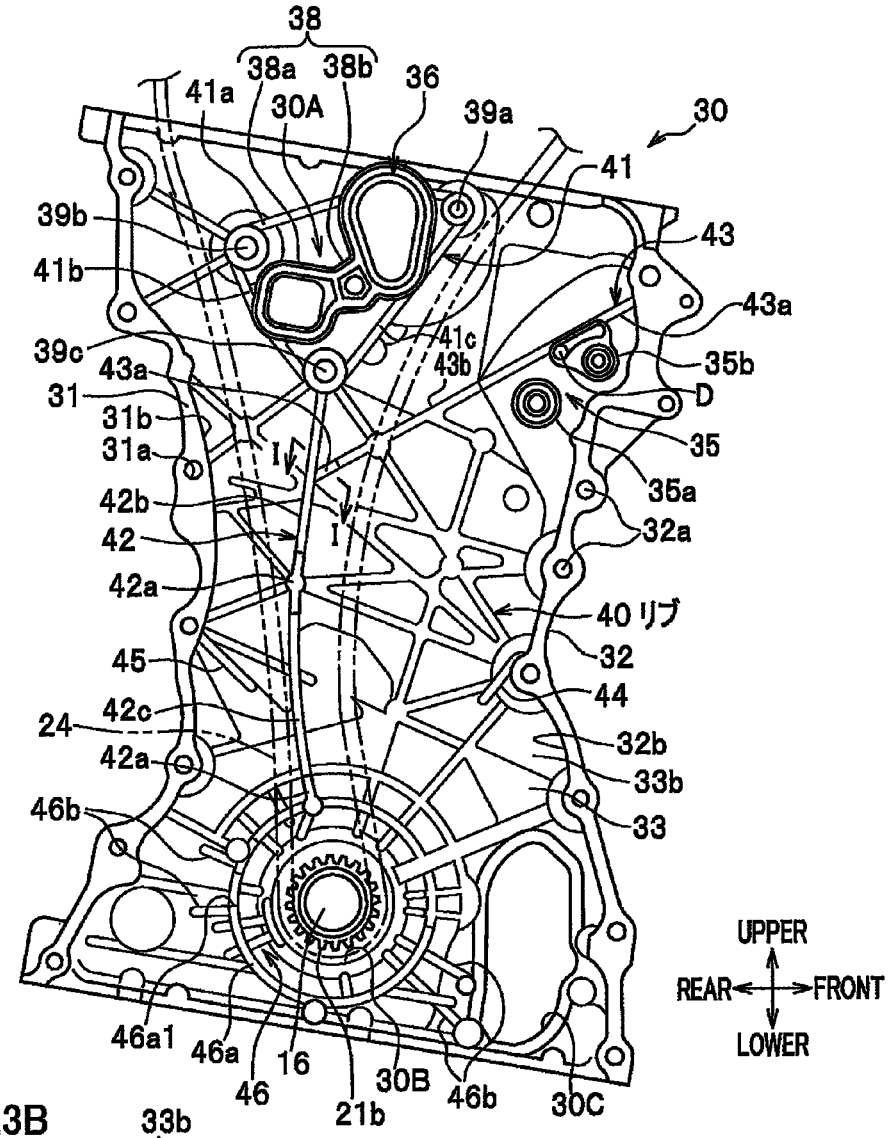
FIG. 3A is a rear view of the chain case and FIG. 3B is cross-sectional view taken along arrow I-I in FIG. 3A.
Figure 3B:
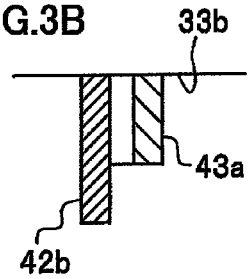
Figure 4:
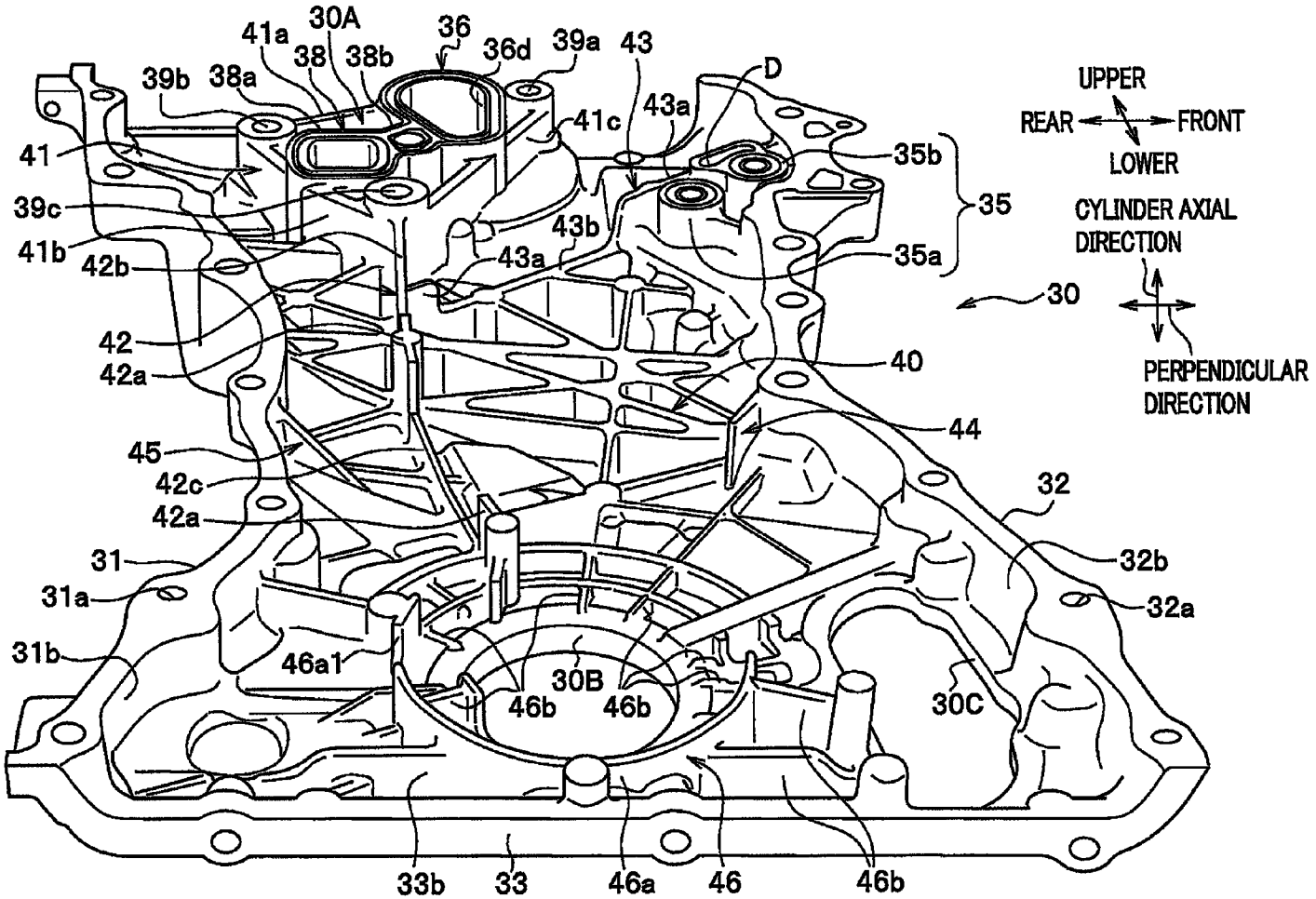
FIG. 4 is a perspective view showing a state of the chain case viewed from an oblique lower point with respect to the cylinder axial direction.

FIG. 3A is a rear view of the chain case 30, and FIG. 3B is a cross-sectional view taken along arrow I-I in FIG. 3A. FIG. 4 is a perspective view showing a state of the chain case 30 viewed from an oblique lower point with respect to the cylinder axial direction. In FIG. 3A, the crankshaft 16, the second gear portion 21*b* of the crank sprocket 21, and the cam timing chain 24 are drawn for convenience of description.

The chain case 30 is a member that has, as shown FIG. 3A and FIG. 4, a U-shape in cross-sectional view, and mainly includes a pair of side marginal portions 31, 32 separated from each other along the lateral direction (front/rear direction), and a wall portion 33 connecting the side marginal portions 31, 32.

Side Marginal Portion

The side marginal portions 31, 32 are formed protruding from the both lateral end portions of the wall portion 33 toward the engine main body 10, and are fixed to the engine main body 10 in contact. The side marginal portions 31, 32 are provided with a plurality of penetrating bolt insertion holes 31*a*, 32*a* at intervals along the extension directions of the side marginal portions 31, 32. The insertion holes 31*a*, 32*a* are provided at positions corresponding to the bolt insertion holes 10*a* of the engine main body 10.

Wall Portion

Figure 5:
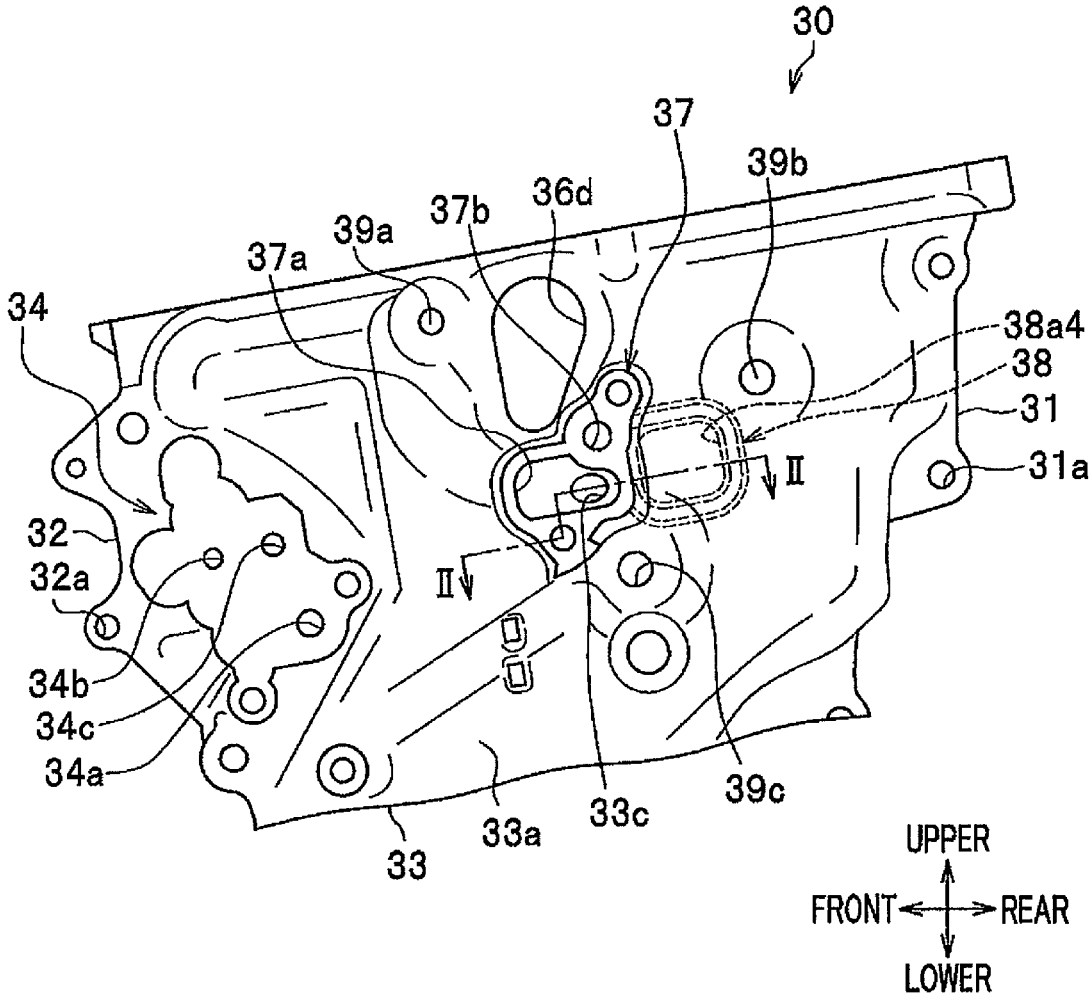
FIG. 5 is a partial front view of the chain case.

FIG. 5 is a partial front view of the chain case 30.

The wall portion 33 mainly includes, as shown in FIG. 3A and FIG. 5, a hydraulic-pressure-control-valve fitting portion 34, a first-oil-path boss portion 35, a variable-valve boss portion 36, a strainer fitting portion 37, a second-oil-path boss portion 38, first-third fastening boss portions 39*a*-39*c*, and a plurality of ribs 40, 40.

Hydraulic-Pressure-Control-Valve Fitting Portion

The hydraulic-pressure-control-valve fitting portion 34 is, as shown in FIG. 5, provided on the upper side of the outer surface 33*a* of the wall portion 33 and in the vicinity of the side marginal portion 32. The hydraulic-pressure-control-valve fitting portion 34 is a portion to which a hydraulic-pressure-control valve (not shown) is fitted. The hydraulic-pressure-control-valve fitting portion 34 is formed, protruding from the outer surface 33*a* of the wall portion 33 by a certain length. Three circular hole portions 34*a*-34*c* are formed, penetrating through the hydraulic-pressure-control-valve fitting portion 34. The hole portion 34*a* communicates with the oil supply path of the hydraulic-pressure-control valve. The hole portion 34*b* communicates with the oil exhaust path of the hydraulic-pressure-control valve. The hole portion 34*c* communicates with the drain portion of the hydraulic-pressure-control valve.

First-Oil-Path Boss Portion

Figure 6:
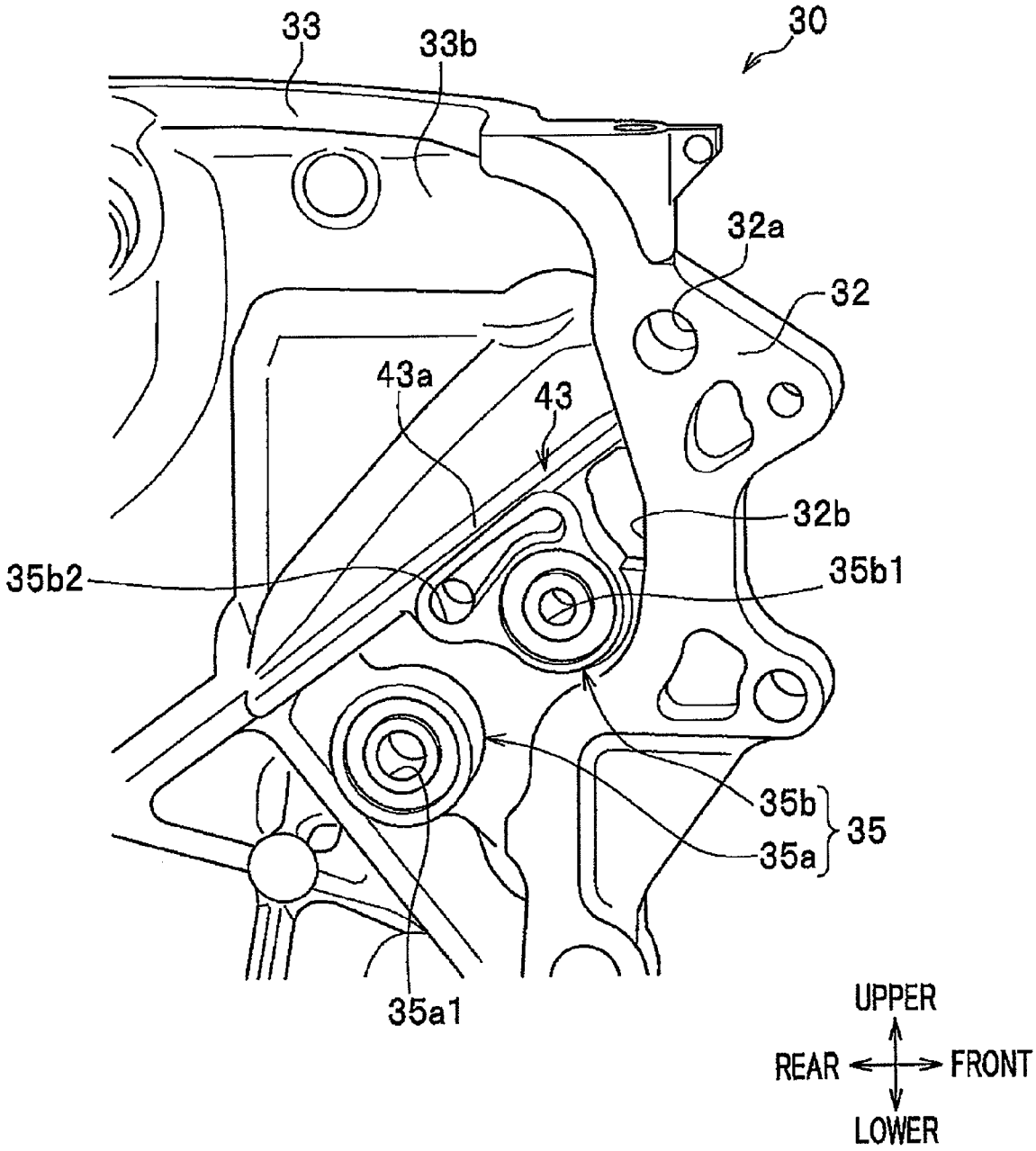
FIG. 6 is a partial enlarged perspective view showing the periphery of the first-oil-path boss portion in FIG. 3A.

FIG. 6 is a partial enlarged perspective view showing the periphery of the first-oil-path boss portion 35 in FIG. 3A.

As shown in FIG. 6, the first-oil-path boss portion 35 is formed, protruding from the inner surface (the surface facing the engine main body 10) 33*b* of the wall portion 33 toward the engine main body 10 by a certain length. The protruding end surface of the first-oil-path boss portion 35 contacts with one side surface of the engine main body 10.

The first-oil-path boss portion 35 includes an oil supply boss portion 35*a* and an oil exhaust boss portion 35*b*.

The oil supply boss portion 35*a* is a portion formed by arranging concentric cylindrical portions with different diameters, in other words, inner and outer cylindrical portions. Through the inner cylindrical portion, formed is a hole portion 35*a*1 communicating with the hole portion 34*a* (see FIG. 5) of the hydraulic-pressure-control-valve fitting portion 34 and an oil path (not shown) of the engine main body 10.

The oil exhaust boss portion 35*b* includes a portion formed by arranging concentric cylindrical portions with different diameters, in other words, inner and outer cylindrical portions, and a portion formed substantially in a quadrangular tube shape continuous from the outer circumferential surface of the outer cylindrical portion. Through the inner cylindrical portion, formed is a hole portion 35*b*1 communicating with the hole portion 34*b* (see FIG. 5) of the hydraulic-pressure-control-valve fitting portion 34 and an oil path (not shown) of the engine main body 10. Through the substantially quadrangular tube, formed is a hole portion 35*b*2 communicating with a hole portion 34*c* of the hydraulic-pressure-control-valve fitting portion 34.

Herein, the hole portion 34*a* and the hole portion 35*a*1 function as an oil supply path for supplying oil from the engine main body 10 to the hydraulic pressure control valve, and the hole portion 34*b* and the hole portion 35*b*1 function as an oil exhaust path for exhausting oil from the hydraulic pressure control valve to the engine main body 10. The hole portion 34*c* and the hole portion 35*b*2 function as a drain oil path D for supplying oil from the drain portion of the hydraulic pressure control valve into the chain case 30. As shown in FIG. 3A, the drain oil path D is disposed upper, in the cylinder axial direction, than a part of the inner surface 32*b* of the side marginal portion 32. Thus, a part of oil supplied from the drain oil path D is caused to surely flow along the inner surface 32*b* of the side marginal portion 32. The drain oil path D is disposed upper, in the cylinder axial direction, than the contact part between the contact portion 27*a* and the movable shoe 26A (see FIG. 2 and FIG. 3A). Thus, oil supplied from the drain oil path D can be guided to the contact part between the contact portion 27*a* and the movable shoe 26A.

Variable Valve Boss Portion

Figure 7:
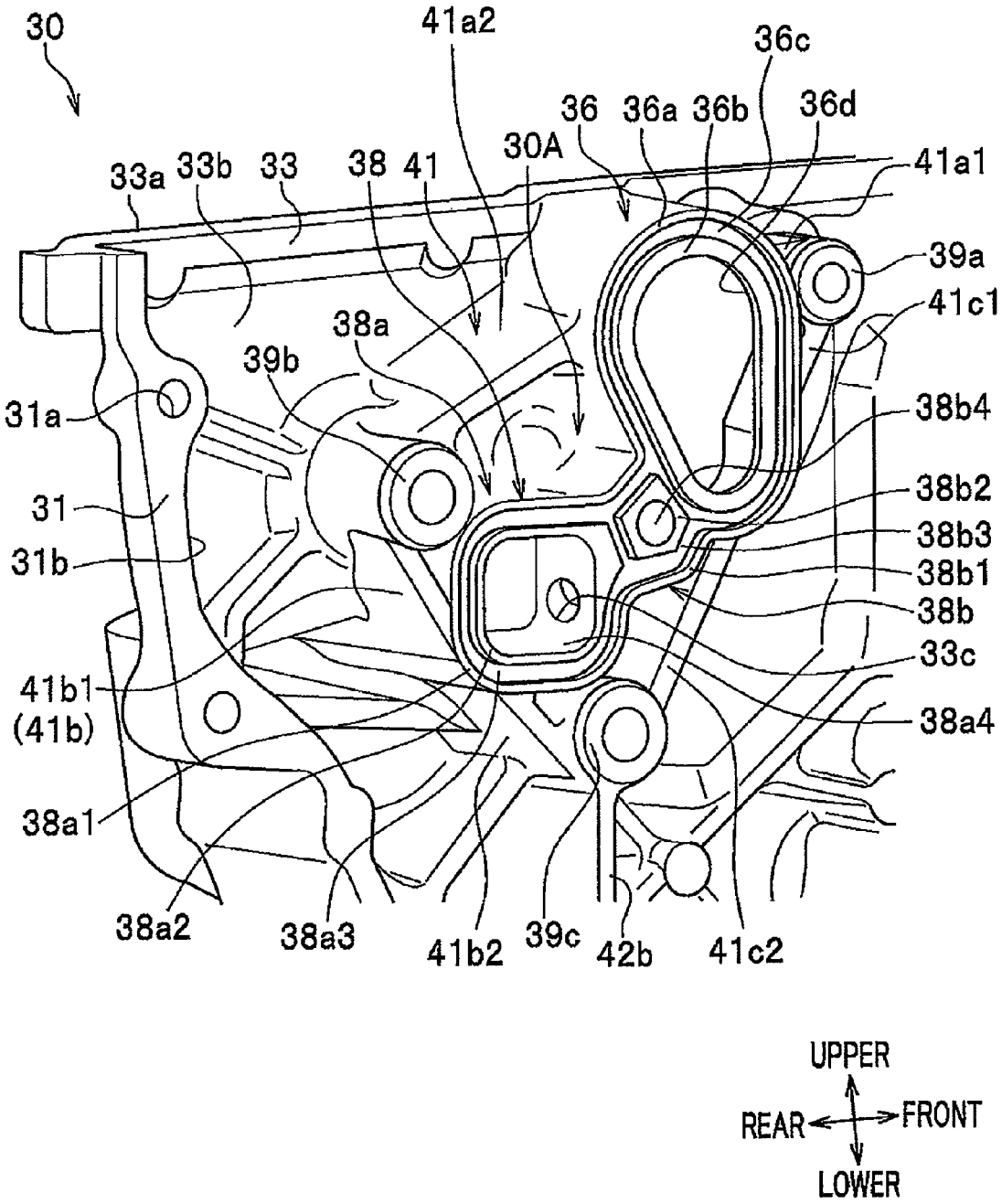
FIG. 7 is a partial enlarged perspective view showing the periphery of a variable-valve boss portion and the second-oil-path boss portion in FIG. 3A.

FIG. 7 is a partial enlarged perspective view showing the periphery of the variable-valve boss portion 36 and the second-oil-path boss portion 38 in FIG. 3A.

As shown in FIG. 7, the variable-valve boss portion 36, which is a main portion, is a portion having a hole portion 36*d* substantially in an egg shape into which a control valve (not shown) for control of a variable valve timing mechanism is inserted. The variable-valve boss portion 36 is provided on the upper side of the wall portion 33 and at a laterally central portion. The variable-valve boss portion 36 includes an outer marginal portion 36*a* formed protruding from the inner surface 33*b* of the wall portion 33 toward the engine main body 10 by a certain length and an inner marginal portion 36*b* formed protruding from the opening edge of the hole portion 36*d* toward the engine main body 10 by a certain length. The protruding end surfaces of the outer marginal portion 36*a* and the inner marginal portion 36*b* are in contact with the one side surface of the engine main body 10. Between the outer marginal portion 36*a* and the inner marginal portion 36*b*, a groove portion 36*c* is formed being recessed toward the outer surface 33*a* of the wall portion 33. The control valve is fitted to the cylinder head 13 (see FIG. 2) through the hole portion 36*d* of the variable-valve boss portion 36.

Second-Oil-Path Boss Portion

The second-oil-path boss portion 38 includes, as shown in FIG. 7, an oil supply boss portion 38*a*, which is provided on the obliquely rear and lower side of the variable-valve boss portion 36 with a certain distance therebetween, and an oil return boss portion 38*b*, which connects the oil supply boss portion 38*a* and the variable-valve boss portion 36.

The oil supply boss portion 38*a*, which is a main portion, is a portion having a recessed portion 38*a*4 substantially in a rectangular tube shape communicating with an oil path (not shown) of the engine main body 10. The oil supply boss portion 38*a* includes an outer marginal portion 38*a*1 formed being protruding from the inner surface 33*b* of the wall portion 33 toward the engine main body 10 by a certain length, and an inner marginal portion 38*a*2 protruding from the opening edge of the recessed portion 38*a*4 toward the engine main body 10 by a certain length. The protruding end surfaces of the outer marginal portion 38*a*1 and the inner marginal portion 38*a*2 are in contact with the one side surface of the engine main body 10. Between the outer marginal portion 38*a*1 and the inner marginal portion 38*a*2, a groove portion 38*a*3 is formed being recessed toward the outer surface 33*a* of the wall portion 33.

The oil return boss portion 38*b*, which is a connection portion, is a portion having a hole portion 38*b*4 in a cylindrical shape for communication between an oil path (not shown) of the engine main body 10 and the hole portion 37*b* of the strainer fitting portion 37. The oil return boss portion 38*b* includes an outer marginal portion 38*b*1 formed being protruding from the inner surface 33*b* of the wall portion 33 toward the engine main body 10 by a certain length, and an inner marginal portion 38*b*2 formed being protruding from the opening edge of the hole portion 38*b*4 toward the engine main body 10 by a certain length. The protruding end surfaces of the outer marginal portion 38*b*1 and the inner marginal portion 38*b*2 are in contact with the one side surface of the engine main body 10. Between the outer marginal portion 38*b*1 and the inner marginal portion 38*b*2, a groove portion 38*b*3 is formed being recessed toward the outer surface 33*a* of the wall portion 33.

Figure 8:
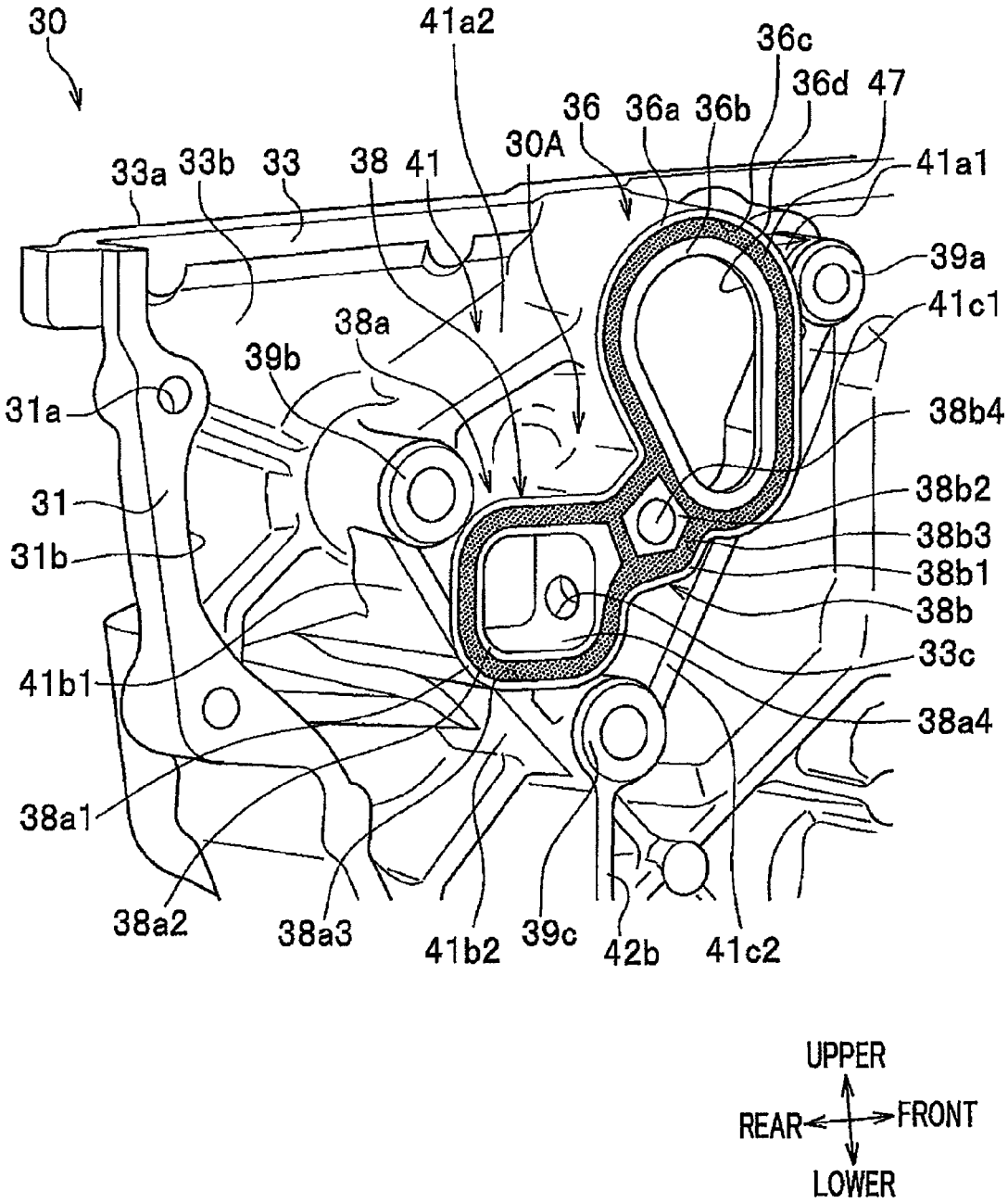
FIG. 8 is a partial enlarged perspective view showing a state that a seal member is attached to the variable-valve boss portion and the second-oil-path boss portion.

FIG. 8 is a partial enlarged perspective view showing a state that a seal member 47 is attached to the variable-valve boss portion 36 and the second-oil-path boss portion 38.

In the present embodiment, as shown in FIG. 7 and FIG. 8, the outer marginal portions 38*a*1, 38*b*1 of the second-oil-path boss portion 38 and the outer marginal portion 36*a* of the variable-valve boss portion 36 are formed integrally and continuously (in a state of a single continuous curve). The groove portions 38*a*3, 38*b*3 of the second-oil-path boss portion 38 and the groove portion 36*c* of the variable-valve boss portion 36 are formed integrally and continuously, wherein a single seal member 47 is attached (engaged by fitting) to these groove portions 38*a*3, 38*b*3, and 36*c*.

The seal member 47 is a member in tight contact (press contact) with the one side surface of the engine main body 10 and seals in terms of gas sealing and liquid sealing between the inner space portion (the hole portion 36*d*, the recessed portion 38*a*4, and the hole portion 38*b*4) of the inner marginal portions 36*b*, 38*a*2, and 38*b*2 and the outer space portion of the outer marginal portions 36*a*, 38*a*1, and 38*b*1. The seal member 47 is in a shape corresponding to the groove portions 38*a*3, 38*b*3, and 36*c* and is provided in the vicinity of a first rib 41.

Strainer Fitting Portion

Figure 9:
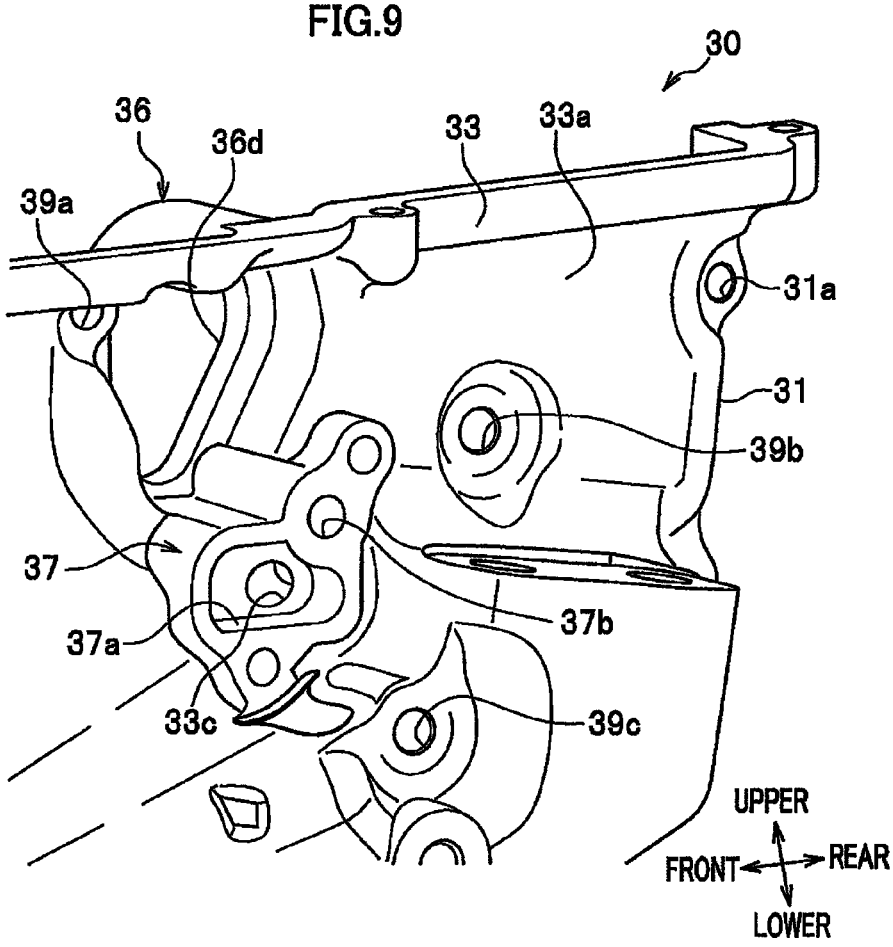
FIG. 9 is a partial enlarged perspective view showing the periphery of the strainer fitting portion in FIG. 5.

FIG. 9 is a partial enlarged perspective view showing the periphery of the strainer fitting portion 37 in FIG. 5

As shown in FIG. 9, the strainer fitting portion 37 is a portion provided below the variable-valve boss portion 36 and a strainer (not shown) is fitted thereto. The strainer fitting portion 37 is formed being protruding from the outer surface 33*a* of the wall portion 33 by a certain length. The strainer fitting portion 37 is provided with a recessed portion 37*a* substantially in a quadrilateral tube shape having a certain inner volume and a hole portion 37*b* in a cylindrical shape. The recessed portion 37*a* and the hole portion 37*b* communicate with the strainer.

Figure 10:
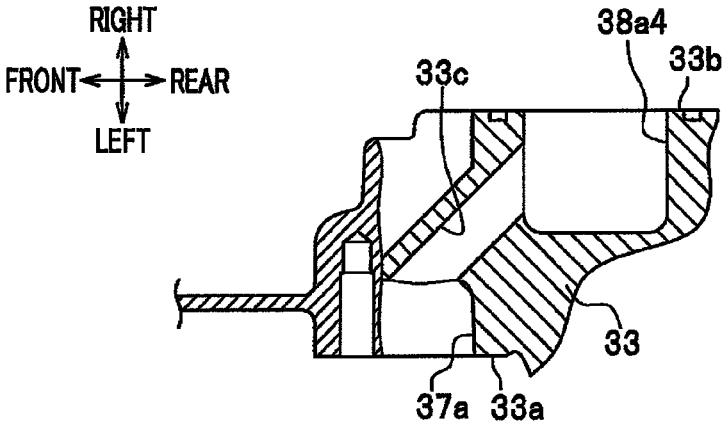
FIG. 10 is a cross-sectional view taken along arrow II-II in FIG. 5.

FIG. 10 is a cross-sectional view taken along arrow II-II in FIG. 5.

As shown in FIG. 5 and FIG. 10, the recessed portion 38*a*4 of the second-oil-path boss portion 38 is provided, being deviated from the recessed portion 37*a* of the strainer fitting portion 37 along the lateral direction. A communication path 33*c* is formed between the recessed portion 38*a*4 and the recessed portion 37*a*, as shown in FIG. 10. One end of the communication path 33*c* is open at the side surface of the recessed portion 38*a*4, and the other end is open at the bottom surface of the recessed portion 37*a*.

Herein, the recessed portion 38*a*4, the communication path 33*c*, and the recessed portion 37*a* function as an oil supply path for supplying oil from the engine main body 10 to the strainer, while the hole portion 37*b* and the hole portion 38*b*4 function as an oil return path for returning oil from the strainer to the engine main body 10. The recessed portion 38*a*4 also functions as a chamber.

Fastening Boss Portion

The first-third fastening boss portions 39*a*-39*c*, which form the central fastening portion, are cylindrical portions fixed by bolts (not shown) at the one side surface of the engine main body 10, as shown in FIG. 7. The respective fastening boss portions 39*a*-39*c* are formed being protruding from the inner surface 33*b* of the wall portion 33 toward the engine main body 10 by a certain length, and the protruding end surfaces of the respective fastening boss portions 39*a*-39*c* are in contact with the one side surface of the engine main body 10. The respective fastening boss portion 39*a*-39*c* are provided around the variable-valve boss portion 36 and the second-oil-path boss portion 38 with distances therebetween. In detail, the first fastening boss portion 39*a* is disposed anterior to the variable-valve boss portion 36. The second fastening boss portion 39*b* is provided on the obliquely rear and lower side of the first fastening boss portion 39*a* with a certain distance therebetween, and is disposed on the obliquely rear and upper side of the oil supply boss portion 38*a*. The third fastening boss portion 39*c* is provided between the first fastening boss portion 39*a* and the second fastening boss portion 39*b*, and on the obliquely front and lower side or on the obliquely rear and lower side of these at certain distances therebetween, and is disposed below the second-oil-path boss portion 38.

In the present embodiment, a recessed portion 30A is formed between the chain case 30 and the engine main body 10, opening upward. The recessed portion 30A, which is a lubricating oil remaining part, is formed by enclosed by the outer marginal portion 36*a* of the variable-valve boss portion 36, the outer marginal portions 38*a*1, 38*b*1 of the second-oil-path boss portion 38, and the second fastening boss portion 39*b*. The recessed portion 30A is a portion where oil that lubricates the timing train mechanism 20 would remain if a later-described upper rib portion 41*a* of the first rib 41 were not provided.

Rib

The ribs 40 protrude, as shown in FIG. 3A and FIG. 4, from the inner surface 33*b* of the wall portion 33 toward the engine main body 10, and formed in a plural number along the cylinder axial direction, the perpendicular direction, the upper/lower direction, the front/rear direction, etc.

The rib 40 mainly includes the first rib 41, a second rib 42, a third rib 43, a fourth rib 44, a fifth rib 45, and a sixth rib 46.

The first rib 41 is disposed such as to enclose the variable-valve boss portion 36 and the second-oil-path boss portion 38. The first rib 41 is a rib substantially in an upside-down triangle shape that respectively connects the first to third fastening boss portions 39*a*-39*c*.

The first rib 41 includes, as shown in FIG. 7 and FIG. 8, an upper rib portion 41*a*, a rear-side lower rib portion 41*b*, and a front-side lower rib portion 41*c*.

The upper rib portion 41*a* is substantially a linear portion that is disposed between the first fastening boss portion 39*a* and the second fastening boss portion 39*b* and is provided upper in the cylinder axial direction than the recessed portion 30A. The upper rib portion 41*a* is divided at a position on the longitudinal direction by the variable-valve boss portion 36 to have an upper end portion 41*a*1 located between the first fastening boss portion 39*a* and the variable-valve boss portion 36 and a lower end portion 41*a*2 located between the variable-valve boss portion 36 and the second fastening boss portion 39*b*. The lower end portion 41*a*2 is inclined downward toward the side marginal portion 31 as farther from the variable-valve boss portion 36 and closer to the second fastening boss portion 39*b*. A part of the seal member 47 is disposed between the upper end portion 41*a*1 and the lower end portion 41*a*2 (see FIG. 8). That is, in the present embodiment, the upper rib portion 41*a* and a part of the seal member 47 connect the space between the first fastening boss portion 39*a* and the second fastening boss portion 39*b*.

Figure 3B:
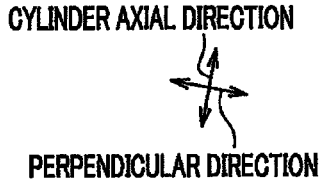

A rear-side lower rib portion 41*b* is a portion substantially in a linear shape and is disposed between the second fastening boss portion 39*b* and the third fastening boss portion 39*c*. The rear-side lower rib portion 41*b* is divided at a position on the longitudinal direction by the oil supply boss portion 38*a* to have an upper end portion 41*b*1 located between the second fastening boss portion 39*b* and the oil supply boss portion 38*a*, and a lower end portion 41*b*2 located between the oil supply boss portion 38*a* and the third fastening boss portion 39*c*. The upper end portion 41*b*1 is inclined downward toward the side marginal portion 32 (see FIG. 3) as farther from the second fastening boss portion 39*b* and closer to the oil supply boss portion 38*a*. The lower end portion 41*b*2 is inclined downward toward the side marginal portion 32 as farther from the oil supply boss portion 38*a* and closer to the third fastening boss portion 39*c*. The lower end portion 41*b*2 is connected to the second rib 42 through the third fastening boss portion 39*c*. A part of the seal member 47 is disposed between the upper end portion 41*b*1 and the lower end portion 41*b*2 (see FIG. 8). That is, in the present embodiment, the rear-side lower rib portion 41*b* and a part of the seal member 47 connect the space between the second fastening boss portion 39*b* and the third fastening boss portion 39*c*.

A front-side lower rib portion 41*c* is a portion substantially in a linear shape and is disposed between the first fastening boss portion 39*a* and the third fastening boss portion 39*c*. The front-side lower rib portion 41*c* is divided at a position on the longitudinal direction by the variable-valve boss portion 36 to have an upper end portion 41*c*1 located between the first fastening boss portion 39*a* and the variable-valve boss portion 36, and a lower end portion 41*c*2 located between the variable-valve boss portion 36 and the third fastening boss portion 39*c*. The upper end portion 41*c*1 is inclined downward toward the side marginal portion 31 as farther from the first fastening boss portion 39*a* and closer to the variable-valve boss portion 36. The lower end portion 41*c*2 is inclined downward toward the side marginal portion 31 as farther from the variable-valve boss portion 36 and closer to the third fastening boss portion 39*c*. The lower end portion 41*c*2 is connected to the second rib 42 through the third fastening boss portion 39*c*. A part of the seal member 47 is disposed between the upper end portion 41*c*1 and the lower end portion 41*c*2 (see FIG. 8). That is, in the present embodiment, the front-side lower rib portion 41*c* and a part of the seal member 47 connect the space between the first fastening boss portion 39*a* and the third fastening boss portion 39*c*.

Returning to FIG. 3A and FIG. 4, the second rib 42 is a rib that is continuous at the upper end portion (on end portion) thereof with the third fastening boss portion 39*c*, and the lower end portion (the other end portion) thereof is located in the vicinity of (directly above) the crank sprocket 21, wherein the second rib 42 extends along the cylinder axial direction. The second rib 42 is, as shown in FIG. 3A, provided inside the cam timing chain 24 (in other words, in the region enclosed by the cam timing chain 24). The second rib 42 includes, as shown in FIG. 4, high rib portions 42*a*, 42*a*, a middle-height rib portion 42*b*, which is lower than the high rib portions 42*a*, and a low rib portion 42*c*, which is lower than the middle-height rib portion 42*b*. The high rib portions 42*a* and the middle-height rib portion 42*b* are formed higher than other ribs 40.

The high rib portions 42*a* are portions that are formed at the midway portion along the longitudinal direction of the second rib 42 and at the lower end portion of the second rib 42, and are in contact with the one side surface of the engine main body 10. The middle-height rib portion 42*b* is a portion formed between the third fastening boss portion 39*c* and the high rib portion 42*a* on the upper side. The low rib portion 42*c* is a portion that is formed by cutting out a part of the second rib 42 by a certain length between the high rib portions 42*a*. The low rib portion 42*c* is provided at a part close, along the cylinder axial direction, to the swingable side (the contact portion 27*a* side) of the movable shoe 26A. By forming the low rib portion 42*c*, it is possible to avoid interference between the cam timing chain 24 and the second rib 42 (see FIG. 2 and FIG. 3A) in the event that the cam timing chain 24 stretches and is pressed by the first hydraulic tensioner device 27 and the movable shoe 26A.

In case that the second rib 42 can be disposed on the stretch side (on the first fixed shoe 26B side) of the cam timing chain 24, and the distance between the second rib 42 and the loose side (the movable shoe 26A side) of the cam timing chain 24 is sufficiently ensured, the low rib portion 42*c* may be omitted and the height of a portion corresponding to the low rib portion 42*c* may be made high. Thus, oil can be flowed further surely toward the engagement part between the crank sprocket 21 and the cam timing chain 24 and between the crank sprocket 21 and the oil pump timing chain 25.

The third rib 43 is, as shown in FIG. 3A, a linear rib provided between the inner surface 32*b* of the side marginal portion 32 and the middle-height rib portion 42*b* of the second rib 42. The third rib 43 is inclined such that the closer to the second rib 42, the lower along the cylinder axial direction. The third rib 43 is, as shown in FIG. 3B, formed lower in terms of height than the middle-height rib portion 42*b* of the second rib 42. The third rib 43 includes, as shown in FIG. 4, high rib portions 43*a*, 43*a* and a low rib portion 43*b* with a height smaller than that of the high rib portions 43*a*.

The high rib portions 43*a* are portions that are formed at the upper and lower end portions of the third rib 43, and are disposed upper, in the cylinder axial direction, than the drain oil path D of the first-oil-path boss portion 35. By forming the high rib portions 43*a*, lubricating oil having flowed along the side marginal portion 32 can be smoothly guided to the third rib 43, and then, can be surely guided from the third rib 43 to the second rib 42. The low rib portion 43*b* is a portion that is formed by cutting out a part of the third rib 43 by a certain length between the high rib portions 43*a* (in other words, at a position midway of the third rib 43 along the longitudinal direction). By forming the low rib portion 43*b*, it is possible to avoid interference between the cam timing chain 24 and the third rib 43 (see FIG. 3A).

The fourth rib 44 is a rib that is disposed lower, in the cylinder axial direction, than the drain oil path D of the first-oil-path boss portion 35, and is in a linear shape protruding from the inner surface 32*b* of the side marginal portion 32 toward the contact portion 27*a* side (see FIG. 2) of the first hydraulic tensioner device 27. The fourth rib 44 is inclined such that the closer to the contact portion 27*a*, the lower in the cylinder axial direction.

The fifth rib 45 is a linearly shaped rib that is disposed, as shown in FIG. 3A, closer to the crank sprocket 21 and protrudes from the inner surface 31*b* of the side marginal portion 31 toward the low rib portion 42*c* of the second rib 42. The fifth rib 45 is inclined, as shown in FIG. 3A and FIG. 4, such that the closer to the second rib 42, the lower in the cylinder axial direction, and the height thereof gradually decreases. By forming the fifth rib 45, lubricating oil having flowed along the side marginal portion 31 can be guided to the second rib 42.

The sixth rib 46 is, as shown in FIG. 3A and FIG. 4, a rib that is formed around an crankshaft insertion hole 30B provided at the laterally-central lower portion of the chain case 30. The sixth rib 46 mainly includes an annular rib 46*a* substantially in an annular shape formed such as to enclose the substantial outer circumference of the crankshaft insertion hole 30B, and a plurality of radial ribs 46*b*, 46*b* that are formed substantially perpendicular to (intersecting with) the annular rib 46*a* and radially with respect to the crankshaft insertion hole 30B.

Figure 11:
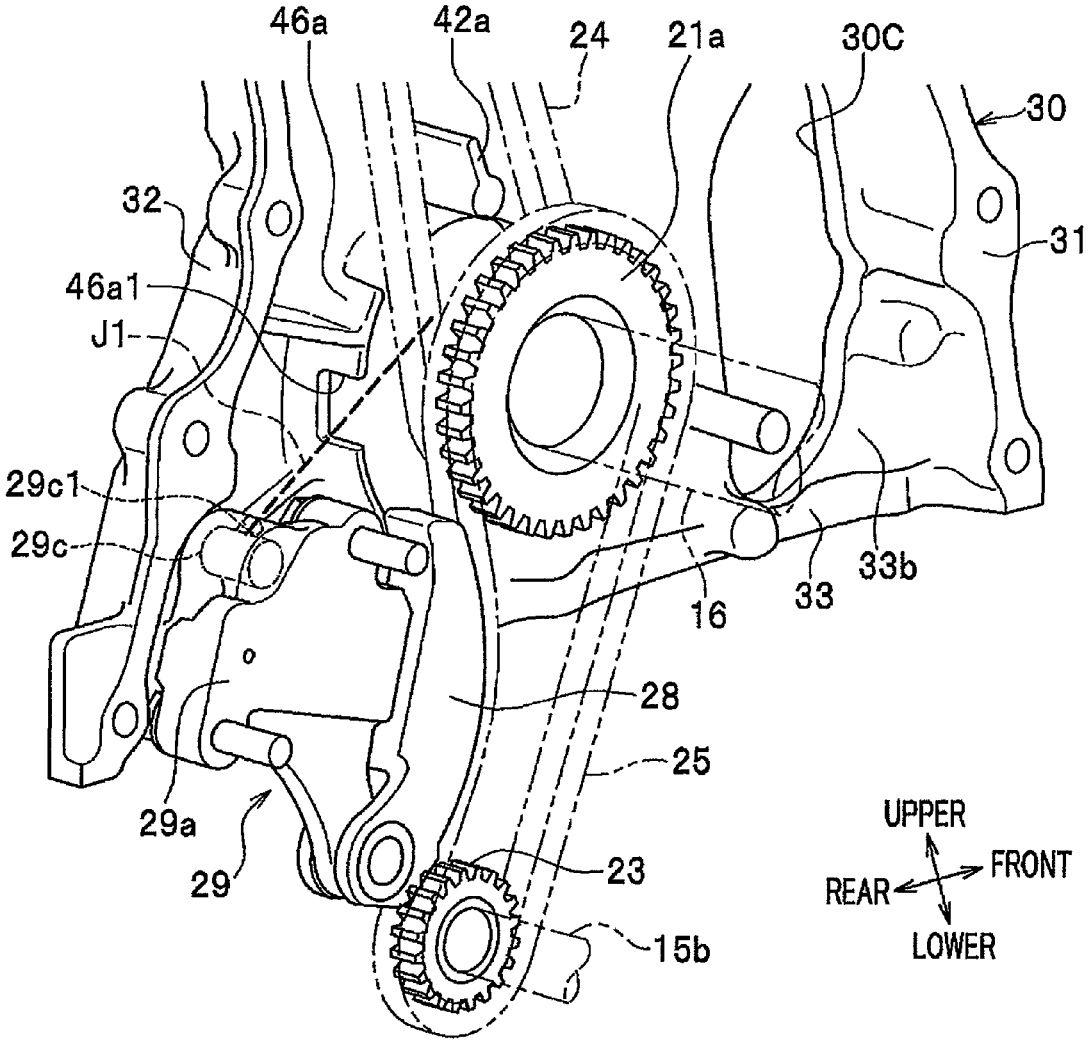
FIG. 11 is a partial perspective view showing a state that the periphery of a crank sprocket is enlarged and viewed from the engine main body side.

FIG. 11 is a partial perspective view showing a state that the periphery of the crank sprocket 21 is enlarged and viewed from the engine main body 10 side.

As shown in FIG. 11, a portion of the annular rib 46*a*, the portion being on extension of the axial line J1 of the relief hole 29*c*1, is provided with a cutout portion 46*a*1 substantially in a rectangular shape. Thus, while reinforcing the periphery of the crankshaft insertion hole 30B, it is possible to surely jet lubricating oil, the lubricating oil being jetted from the relief hole 29*c*1, to the engagement part between the crank sprocket 21 and the cam timing chain 24 and between the crank sprocket 21 and the oil pump timing chain 25.

Anterior to the crankshaft insertion hole 30B, an penetrating opening portion 30C is formed to enable viewing the first hydraulic tensioner device 27 (see FIG. 1A).

Figure 12:
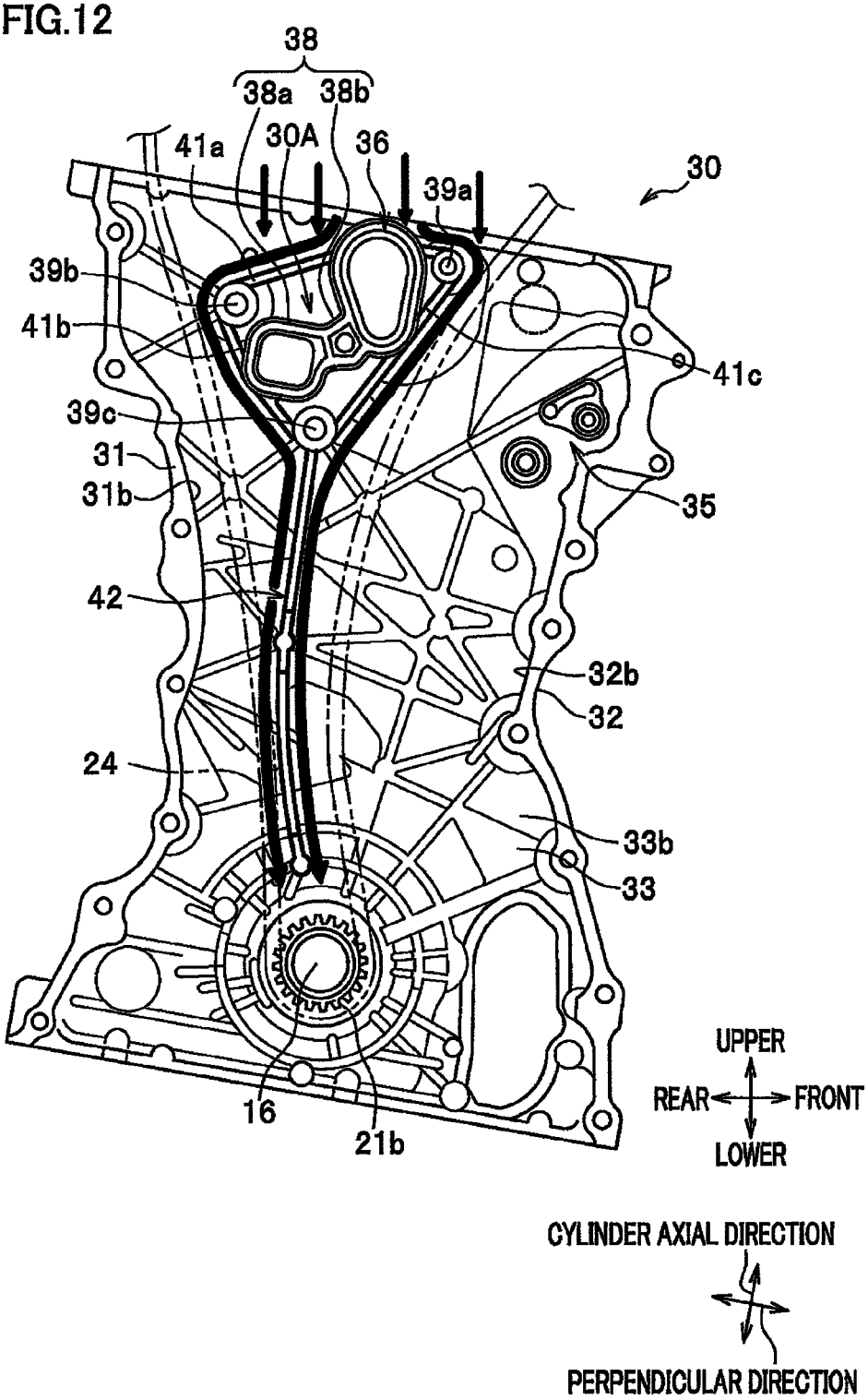
FIG. 12 is a side view schematically showing the flow of lubricating oil along the first rib and the second rib viewed from the engine main body side.
Figure 13:
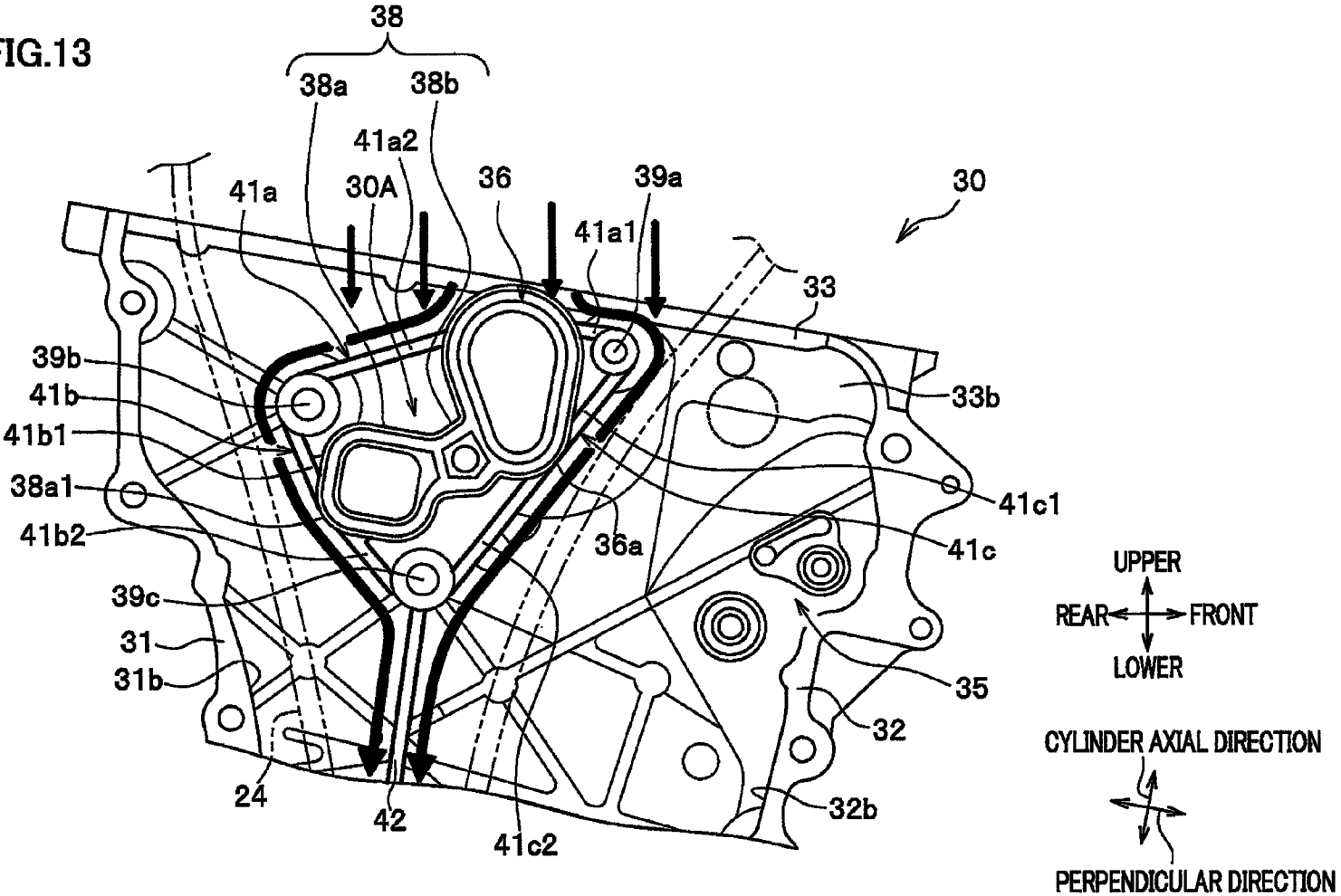
FIG. 13 is a partial enlarged side view of FIG. 12.
Figure 14:
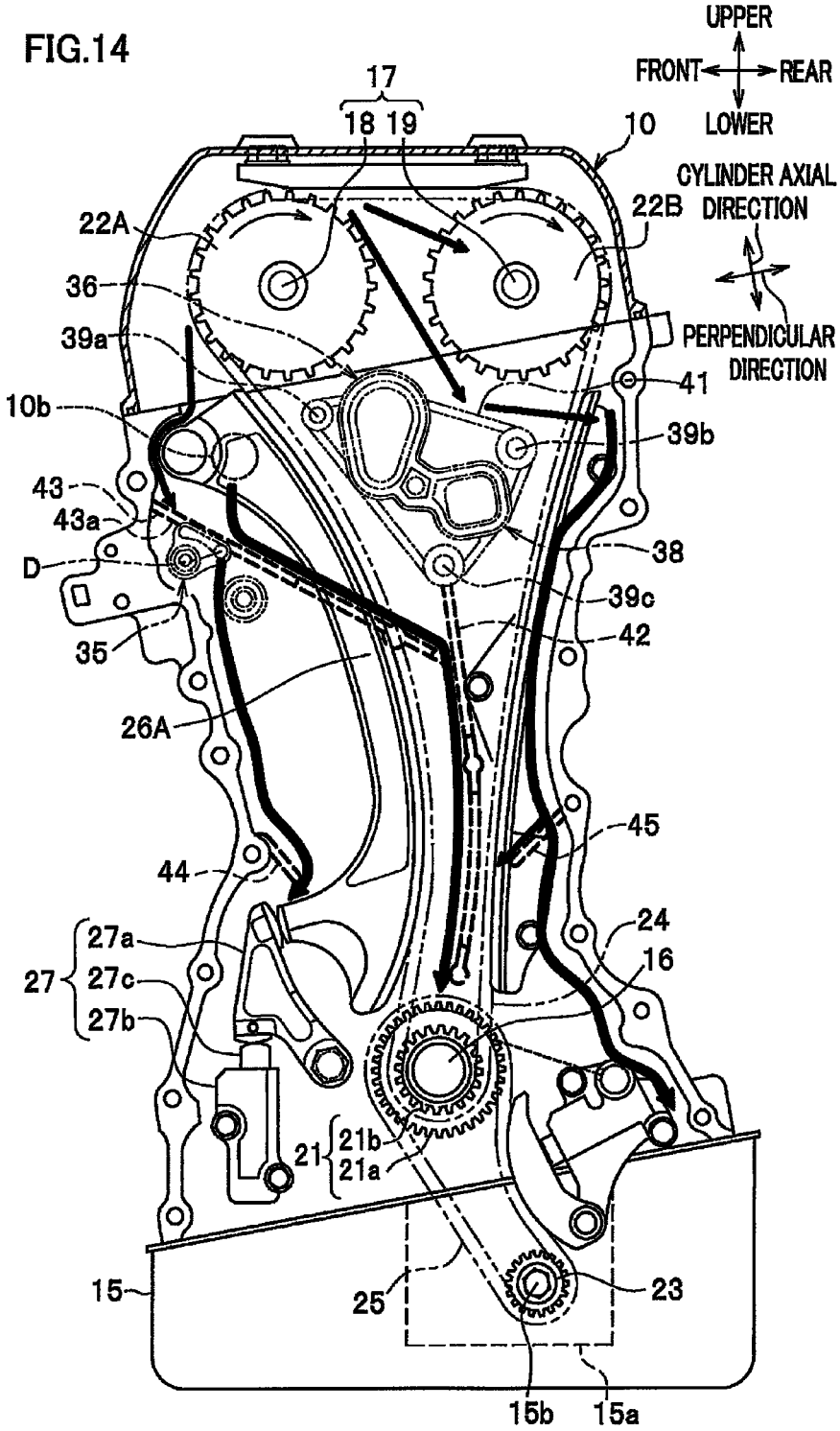
FIG. 14 is a side view schematically showing the flow of lubricating oil along the second-fifth ribs, viewed from the chain case side.
Figure 15:
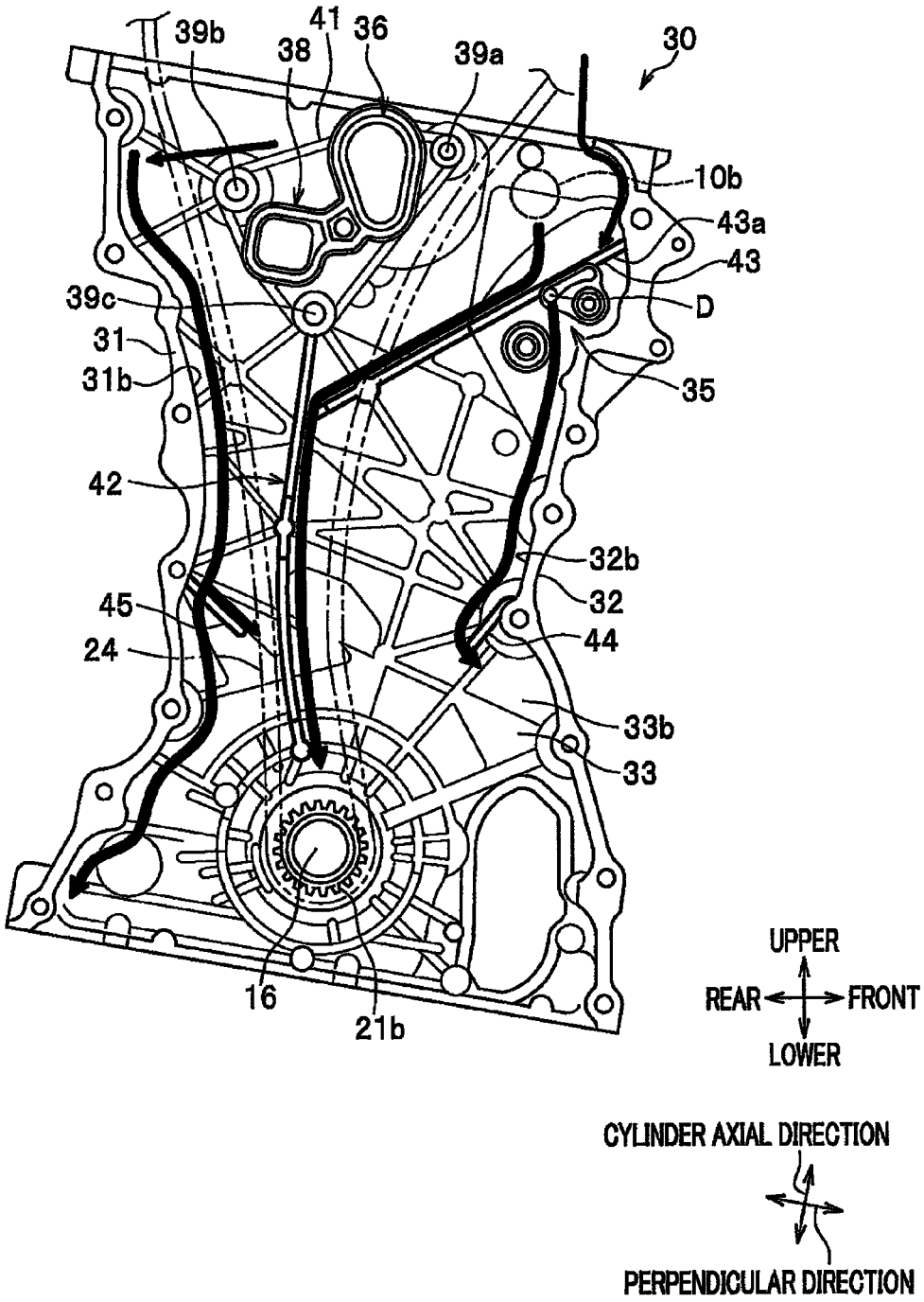
FIG. 15 is a side view schematically showing the flow of the lubricating oil along the second-fifth ribs viewed from the engine main body side.

The engine E having a cover structure for an internal combustion engine related to the present embodiment is basically configured as described above. Mainly with reference to FIGS. 12 to 15, the operation and advantages will be described below. FIG. 12 is a side view schematically showing the flow of lubricating oil along the first rib 41 and the second rib 42 viewed from the engine main body 10 side. FIG. 13 is a partial enlarged side view of FIG. 12. FIG. 14 is a side view schematically showing the flow of lubricating oil along the ribs, namely the second-fifth ribs 42-45, viewed from the chain case 30 side. FIG. 15 is a side view schematically showing the flow of the lubricating oil along the ribs, namely the second-fifth ribs 42-45, viewed from the engine main body 10 side.

In FIG. 14, ribs, namely the first-fifth ribs 41-45 and the like are shown being projected onto the engine main body 10 for convenience of illustration. In FIGS. 12 to 15, the crankshaft 16, the second gear portion 21*b* of the crank sprocket 21, and the cam timing chain 24 are shown for convenience of illustration.

As shown in FIG. 2, when the crankshaft 16 rotates by a start of the engine E, the crank sprocket 21 fitted to the crankshaft 16 rotates, and this rotation is transmitted to the cam sprockets 22A, 22B by the cam timing chain 24. The two camshafts 17 rotate, accompanying the rotation of the cam sprockets 22A, 22B. Thus, the intake valve and the exhaust valve, not shown, open and close at certain timings.

On the other hand, the rotation of the crank sprocket 21 is transmitted by the oil pump timing chain 25 to the oil pump sprocket 23, and the pump driving shaft 15*b* rotates, accompanying the rotation of the oil pump sprocket 23. Thus, the oil pump 15*a* drives to suck up oil in the oil pan 15 and the oil is supplied to respective portions of the engine E.

A part of the oil is supplied to the inside of the chain case 30 through the engagement part between the cam sprockets 22A and the cam timing chain 24, the oil drop portion 10*b*, the drain oil path D, and the like (see FIGS. 12 to 15).

As shown in FIG. 12, the oil supplied from the engagement part between the cam sprocket 22A and the cam timing chain 24, and the like, downward flows along the inner surface 33*b* of the wall portion 33.

As shown in FIG. 13, when the oil having flowed along the wall portion 33 has reached the lower end portion 41*a*2 of the upper rib portion 41*a*, the oil flows toward the second fastening boss portion 39*b* along the lower end portion 41*a*2.

Herein, as the lower end portion 41*a*2 of the upper rib portion 41*a* is downward inclined toward the side marginal portion 31, the oil surely flows toward the second fastening boss portion 39*b* by the own weight thereof.

Subsequently, when the oil has reached the second fastening boss portion 39*b*, the oil flows along the outer circumferential surface of the second fastening boss portion 39*b* toward the upper end portion 41*b*1 of the rear-side lower rib portion 41*b*.

Subsequently, when the oil has reached the upper end portion 41*b*1 of the rear-side lower rib portion 41*b*, the oil flows through the upper end portion 41*b*1, the outer marginal portion 38*a*1 of the second-oil-path boss portion 38, and the lower end portion 41*b*2 of the rear-side lower rib portion 41*b* toward the third fastening boss portion 39*c*.

Herein, as the upper end portion 41*b*1 and the lower end portion 41*b*2 of the rear-side lower rib portion 41*b* are downward inclined toward the side marginal portion 32, the oil surely flows toward the third fastening boss portion 39*c* by the own weight thereof.

Subsequently, when the oil has reached the third fastening boss portion 39*c*, the oil flows along the outer circumferential surface of the third fastening boss portion 39*c* toward the second rib 42.

Then, as shown in FIG. 12, when the oil has reached the second rib 42, the oil flows along the second rib 42 toward the engagement part between the crank sprocket 21 and the cam timing chain 24 and between the crank sprocket 21 and the oil pump timing chain 25 (see FIG. 2).

On the other hand, as shown in FIG. 13, when the oil having flowed along the wall portion 33 has reached the upper end portion 41*a*1 of the upper rib portion 41*a*, the oil flows along the outer circumferential surface of the first fastening boss portion 39*a* toward the upper end portion 41*c*1 of the front-side lower rib portion 41*c*.

Subsequently, when the oil has reached the upper end portion 41*c*1 of the front-side lower rib portion 41*c*, the oil flows along the upper end portion 41*c*1, the outer marginal portion 36*a* of the variable-valve boss portion 36, and the lower end portion 41*c*2 of the front-side lower rib portion 41*c* toward the third fastening boss portion 39*c*.

Herein, as the upper end portion 41*c*1 and the lower end portion 41*c*2 of the front-side lower rib portion 41*c* are downward inclined toward the side marginal portion 31, the oil surely flows toward the third fastening boss portion 39*c* by the own weight thereof.

Subsequently, when the oil has reached the third fastening boss portion 39*c*, the oil flows along the outer circumferential surface of the third fastening boss portion 39*c* toward the second rib 42.

Then, as shown in FIG. 12, when the oil has reached the second rib 42, the oil flows along the second rib 42 toward the engagement part between the crank sprocket 21 and the cam timing chain 24 and between the crank sprocket 21 and the oil pump timing chain 25.

Further, as shown in FIG. 15, when the oil having flowed along the side marginal portion 32 and the wall portion 33 has reached the third rib 43, the oil flows along the third rib 43 toward the second rib 42.

Herein, as the third rib 43 has the high rib portion 43*a* at the end portion on the side marginal portion 32 side, the oil having flowed along the side marginal portion 32 is ensured to be guided to the third rib 43.

Further, as the third rib 43 is inclined such that the closer to the second rib 42, the lower in the cylinder axial direction, and the second rib 42 is formed to be lower than the third rib 43, the oil having flowed along the third rib 43 is ensured to be guided to the second rib 42.

Subsequently, as shown in FIG. 14, when the oil having flowed along the third rib 43 has reached the second rib 42, the oil flows along the second rib 42 toward the engagement part between the crank sprocket 21 and the cam timing chain 24 and between the crank sprocket 21 and the oil pump timing chain 25. Thus, this engagement part can be satisfactorily lubricated.

Further, as shown in FIG. 15, the oil having been supplied from the drain oil path D downward flows along the inner surface 32*b* of the side marginal portion 32 and the inner surface 33*b* of the wall portion 33.

Herein, as the drain oil path D is disposed upper, in the cylinder axial direction, than a part of the inner surface 32*b* of the side marginal portion 32, a part of oil supplied from the drain oil path D is ensured to flow along the inner surface 32*b* of the side marginal portion 32.

Still further, as shown in FIG. 14, the drain oil path D is disposed upper, in the cylinder axial direction, than the contact part between the contact portion 27*a* and the movable shoe 26A, a part of the oil supplied from the drain oil path D flows along the inner surface 32*b* of the side marginal portion 32 and the inner surface 33*b* of the wall portion 33 toward the contact part between the contact portion 27*a* and the movable shoe 26A.

Then, as shown in FIGS. 14 and 15, when the oil having flowed along the inner surface 32*b* of the side marginal portion 32 and the inner surface 33*b* of the wall portion 33 has reached the fourth rib 44, the oil flows along the fourth rib 44 toward the contact part between the contact portion 27*a* of the first hydraulic tensioner device 27 and the movable shoe 26A.

Herein, the fourth rib 44 protrudes from the inner surface 32*b* of the side marginal portion 32 toward the contact portion 27*a* side of the first hydraulic tensioner device 27 and is inclined such that the closer to the contact portion 27*a*, the lower in the cylinder axial direction. Accordingly, the oil having flowed along the side marginal portion 32 is ensured to be guided to the contact part. Thus, the part at the contact part can be satisfactorily lubricated.

Further, as shown in FIG. 15, when the oil having flowed along the inner surface 31*b* of the side marginal portion 31 and the inner surface 33*b* of the wall portion 33 has reached the fifth rib 45, a part of the oil flows along the fifth rib 45 toward the second rib 42.

Herein, the fifth rib 45 protrudes from the inner surface 31*b* of the side marginal portion 31 toward the second rib 42, and also is inclined such that the closer to the second rib 42, the lower in the cylinder axial direction. Accordingly, the oil having flowed along the inner surface 31*b* of the side marginal portion 31 can be satisfactorily guided to the second rib 42.

Subsequently, as shown in FIG. 14, when the oil having flowed along the fifth rib 45 has reached the second rib 42, the oil flows along the second rib 42 toward the engagement part between the crank sprocket 21 and the cam timing chain 24 and between the crank sprocket 21 and the oil pump timing chain 25. Thus, this engagement part can be further satisfactorily lubricated.

In the foregoing embodiment, as the lower end portion 41*a*2 of the upper rib portion 41*a* is provided upper, in the cylinder axial direction, than the recessed portion 30A, which is a lubricating oil remaining part, oil having flowed along the inner surface 33*b* of the wall portion 33 is guided to the lower end portion 41*a*2 of the upper rib portion 41*a*, and is caused to flow along the lower end portion 41*a*2 of the upper rib portion 41*a*. Thus, remaining of oil in the recessed portion 30A can be inhibited.

Particularly, in the present embodiment, as the first rib 41 is disposed such as to enclose the periphery of the variable-valve boss portion 36 and the second-oil-path boss portion 38, remaining of oil at the variable-valve boss portion 36 and the second-oil-path boss portion 38 including the recessed portion 30A is further inhibited.

In the present embodiment, the respective upper rib portions 41*a*-41*c* forming the first rib 41 are inclined toward either the side marginal portion 31 or the side marginal portion 32 and also is formed substantially in a linear shape. Accordingly, oil smoothly and surely flows along the respective upper rib portions 41*a*-41*c* by the own weight thereof. Thus, remaining of oil at the first rib 41 can be inhibited.

In the present embodiment, as the seal member 47 is provided in the vicinity of the first rib 41, the rigidity in the vicinity of the seal member 47 is improved, and the tight contact of the seal member 47 with the engine main body 10 is improved. Thus, a satisfactory sealing can be ensured.

Particularly, in the present embodiment, the spaces between the first fastening boss portions 39*a*-39*c* are connected by the first rib 41 and a part of the seal member 47, and the first rib 41 and the part of the seal member 47 are thus disposed adjacent to each other. Accordingly, a still more excellent sealing is ensured.

In the present embodiment, as the first rib 41 is formed substantially in an upside-down triangle, oil having flowed along the inner surface 33*b* of the wall portion 33 is caused to flow along the respective upper rib portions 41*a*-41*c* and be collected by the lower end portions 41*b*2, 41*b*3. Further, as the lower end portions 41*b*2, 41*b*3 are connected to the upper end portion of the second rib 42 through the third fastening boss portion 39*c*, the oil collected by the lower end portions 41*b*2, 41*b*3 is caused to be guided to the second rib 42. Thereafter, the oil flows along the second rib 42 to be guided to the engagement part between the crank sprocket 21 and the cam timing chain 24 and between the crank sprocket 21 and the oil pump timing chain 25. Thus, oil can be quickly recovered.

In the present embodiment, oil having flowed along the inner surface 32*b* of the side marginal portion 32 and the inner surface 33*b* of the wall portion 33 can be surely guided by the second rib 42 and the third rib 43 to the engagement part between the crank sprocket 21 and the cam timing chain 24 and between the crank sprocket 21 and the oil pump timing chain 25.

Further, oil having flowed along the inner surface 31*b* of the side marginal portion 31 and the inner surface 33*b* of the wall portion 33 can be guided to the engagement part between the crank sprocket 21 and the cam timing chain 24 and between the crank sprocket 21 and the oil pump timing chain 25.

Further, while the contact part between the contact portion 27*a* and the movable shoe 26A is disposed lower than the drain oil path D, as the third rib 43 is disposed upper than the drain oil path D, oil having been supplied from the drain oil path D and flowed along the inner surface 32*b* of the side marginal portion 32 and the inner surface 33*b* of the wall portion 33 can be guided to the contact part between the contact portion 27*a* of the first hydraulic tensioner device 27 and the movable shoe 26A. Particularly, in the present embodiment, as the fourth rib 44 is disposed lower than the drain oil path D, oil can be guided further satisfactorily to the contact part between the contact portion 27*a* and the movable shoe 26A.

Accordingly, oil in the chain case 30 does not remain, and the oil can be divided to the engagement part and the contact part to enable satisfactory lubrication.

In the present embodiment, as the second rib 42, which is the highest of the ribs 40, is disposed inside the cam timing chain 24, interference between the second rib 42 and the cam timing chain 24 can be prevented. Further, as interference between these two can be prevented, the height of the second rib 42 can be freely set.

Still further, as the third rib 43, which is relatively high among the ribs 40, has the low rib portion 43*b* at midway along the longitudinal direction, interference between the third rib 43 and the cam timing chain 24 can be prevented by arranging the cam timing chain 24 such as to pass the low rib portion 43*b*.

A preferred embodiment according to the present invention has been described above in detail with reference to the drawings, however, the invention is not limited thereto and modifications and changes can be made within a scope not departing from the spirit of the invention.

In the present embodiment, the invention has been applied to an engine E for an automobile, however, the invention may also be applied to an engine for a vessel, a general machine, or the like other than automobiles.

In the present embodiment, the invention has been applied to a tandem engine E, however, the invention may be applied to a different type of engine (for example, a V-type engine).

In the present embodiment, an arrangement has been made such that the cylinder axial direction is inclined by a certain angle toward the front side from the upper/lower direction (vertical direction), however, the cylinder axial direction may be inclined by a certain angle toward the rear side from the upper/lower direction or may agree with the upper/lower direction (vertical direction).

In the present embodiment, the lubricating oil remaining part (the recessed portion 30A) is formed by plural (two) protrusion portions, which are the variable-valve boss portion 36 and the second-oil-path boss portion 38, however, the lubricating oil remaining part may be formed by a single protrusion portion.

In the present embodiment, the present invention has been applied to the protrusion portions of the variable-valve boss portion 36 and the second-oil-path boss portion 38, which have portions for communication between the inside and the outside of the chain case 30, however, the invention may be applied to other protrusion portions without a portion for communication between the inside and the outside of the chain case 30.

In the present embodiment, the first rib 41 includes the upper rib portion 41*a*, the rear-side lower rib portion 41*b*, and the front-side lower rib portion 41*c*, however, an arrangement may be made such that the first rib 41 includes at least the upper rib portion 41*a* disposed upper, in the cylinder axial direction, than the recessed portion 30A, and both or either of the rear-side lower rib portion 41*b* and the front-side lower rib portion 41*c* may be omitted.

In the present embodiment, the upper rib portion 41*a* is divided at a position along the longitudinal direction by the variable-valve boss portion 36 and is formed substantially in a linear shape, however, an arrangement may be made such that the upper rib portion 41*a* is disposed on the upper side of the variable-valve boss portion 36, and the upper end portion 41*a*1 and the lower end portion 41*a*2 are integrally and continuously formed, being downward inclined with an upward facing convex shape.

In the present embodiment, the second rib 42 has three ribs with different heights, namely the high rib portion 42*a*, the middle-height rib portion 42*b*, and the low rib portion 42*c*, however, the height of the second rib 42 may be set as appropriate. For example, the second rib 42 may have two rib portions with different heights.

In the present embodiment, the third rib 43 includes two rib portions with different heights, namely the high rib portion 43*a* and the low rib portion 43*b*, however, the height of the third rib 43 may be set as appropriate. For example, the third rib 43 may have three rib portions with different heights.

In the present embodiment, the third rib 43 is provided between the side marginal portion 32 and the second rib 42, however, the third rib 43 may be provided between the side marginal portion 31 and the second rib 42, or third ribs 43 may be provided both between the side marginal portion 31 and the second rib 42 and between the side marginal portion 32 and the second rib 42.

In the present embodiment, the first hydraulic tensioner device 27 includes the contact portion 27*a*, and the contact portion 27*a* contacts with the movable shoe 26A, however, an arrangement may be made such that the contact portion 27*a* is omitted and the plunger 27*c* contacts with the movable shoe 26A.

In this case, in order that oil having been supplied from the drain oil path D is guided to the contact part between the plunger 27*c* and the movable shoe 26A, the positions of the movable shoe 26A, the plunger 27*c*, the drain oil path D, and the fifth rib 45 are adjusted, as appropriate.

What is claimed is:

1. A cover structure for an internal combustion engine, comprising:

a timing train mechanism provided on one sidewall of a main body of the internal combustion engine; and a cover member for covering the timing train mechanism, a timing train chamber is formed between the cover member and the main body of the internal combustion engine, wherein the cover member comprises:

side fastening portions that are provided at a pair of side marginal portions separated from each other and fastened to the main body of the internal combustion engine;

a protrusion portion that protrudes from an inner surface of a wall portion connecting the pair of side marginal portions toward the main body of the internal combustion engine and has a lubricating oil remaining part where lubricating oil for lubricating the timing train mechanism remains; and a first rib that protrudes from the inner surface of the wall portion toward the main body of the internal combustion engine and is provided upper in a cylinder axial direction than at least the lubricating oil remaining part, and wherein a part of the first rib is downward inclined toward either one of the pair of side marginal portions to cover the lubricating oil remaining part, and extends in a side direction beyond the protrusion portion and the lubricating oil remaining part.

2. The cover structure for an internal combustion engine according to claim 1, wherein the protrusion portion comprises a plurality of main body portions provided with respective certain distances therebetween and connection portions connecting the main body portions, wherein the lubricating oil remaining part is formed upper than the main body portions and the connection portions, and wherein the first rib is provided such as to enclose the main body portions and the connection portions.

3. The cover structure for an internal combustion engine according to claim 1, wherein the part of the first rib is arranged upper in the cylinder axial direction than the lubricating oil remaining part, and is substantially linearly formed.

4. The cover structure for an internal combustion engine according to claim 1, wherein a protrusion end surface of the protrusion portion is in contact with the one sidewall of the main body of the internal combustion engine, wherein the cover member further comprises a seal member provided between the protrusion portion and the main body of the internal combustion engine, and wherein the seal member is provided in a vicinity of the first rib.

5. The cover structure for an internal combustion engine according to claim 4, wherein the cover member further comprises a plurality of central fastening portions that are provided at the wall portion and fastened to the main body of the internal combustion engine, wherein the central fastening portions are provided with respective certain distances therebetween around the protrusion portion, and wherein the central fastening portions are connected by the first rib and at least a part of the seal member.

6. The cover structure for an internal combustion engine according to claim 1, wherein the cover member further comprises a second rib that protrudes from the inner surface of the wall portion toward the main body of the internal combustion engine and extends along the cylinder axial direction, and wherein the first rib is formed substantially in an upside-down triangle shape and is adapted to enclose the protrusion portion and a lower end portion thereof is connected to the second rib.

7. The cover structure for an internal combustion engine according to claim 6, wherein the timing train mechanism comprises:

a driving wheel;

a driven wheel; and an endless timing chain suspended between the driving wheel and the driven wheel, wherein the cover member further comprises a third rib that protrudes from the inner surface of the wall portion toward the main body of the internal combustion engine, the third rib being provided between both or either one of the pair of side marginal portions and the second rib, and is inclined such that the closer to the second rib, the lower in the cylinder axial direction, wherein the second rib is provided on an inner side of the timing chain and formed higher than the third rib, and a lower end portion, in the cylinder axial direction, of the second rib is located upper in the cylinder axial direction than the driving wheel, and wherein the third rib is formed such that an end portion on the side marginal portion side is higher than a portion midway along a longitudinal direction.

8. The cover structure for an internal combustion engine according to claim 7, wherein the timing train mechanism further comprises:

a slide-contact member that slidably contacts with the timing chain to apply a certain tension; and an urging member having a contact portion that contacts with the slide-contact member to urge the slide-contact member toward the timing chain, wherein a drain oil path communicating with a drain portion of a hydraulic control valve is provided in a vicinity of either one of the pair of side marginal portions, wherein the contact portion is provided lower in the cylinder axial direction than the drain oil path, and wherein the third rib is provided upper in the cylinder axial direction than the drain oil path.

9. The cover structure for an internal combustion engine according to claim 8, wherein the cover member further comprises a fourth rib that protrudes from the one side marginal portion toward the contact portion side and is provided lower in the cylinder axial direction than the drain oil path.

* * * * *